US011046093B2

(12) United States Patent
Allison et al.

(10) Patent No.: US 11,046,093 B2
(45) **Date of Patent: *Jun. 29, 2021**

(54) REFLECTORS FOR EVENLY HEATING A DRUM DRYER OF A PRINT SYSTEM

(71) Applicants: John Davis Allison, Boulder, CO (US); Stuart James Boland, Denver, CO (US); Scott R. Johnson, Erie, CO (US); Lucas Michael Stahler, Broomfield, CO (US); Casey Ethan Walker, Boulder, CO (US)

(72) Inventors: John Davis Allison, Boulder, CO (US); Stuart James Boland, Denver, CO (US); Scott R. Johnson, Erie, CO (US); Lucas Michael Stahler, Broomfield, CO (US); Casey Ethan Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/681,440

(22) Filed: Nov. 12, 2019

(65) Prior Publication Data

US 2020/0079115 A1 Mar. 12, 2020

Related U.S. Application Data

(63) Continuation of application No. 15/954,297, filed on Apr. 16, 2018, now Pat. No. 10,500,783, which is a continuation of application No. 15/279,921, filed on Sep. 29, 2016, now Pat. No. 9,987,859.

(51) Int. Cl.

| | |
|---|---|
| ***B41J 11/00*** | (2006.01) |
| ***F26B 13/00*** | (2006.01) |
| ***F26B 3/20*** | (2006.01) |
| *F26B 13/18* | (2006.01) |

(52) U.S. Cl.

CPC ..... *B41J 11/002* (2013.01); *F26B 3/20* (2013.01); *F26B 13/008* (2013.01); *F26B 13/183* (2013.01)

(58) Field of Classification Search

CPC ..... B41J 11/002; F26B 13/008; F26B 3/20; F26B 13/183

See application file for complete search history.

(56) References Cited

U.S. PATENT DOCUMENTS

| | | | |
|---|---|---|---|
| 4,350,412 | A | 9/1982 | Steenblik et al. |
| 4,561,425 | A | 12/1985 | Long et al. |
| 5,771,054 | A | 6/1998 | Dudek et al. |

(Continued)

*Primary Examiner* — Sharon Polk

(74) *Attorney, Agent, or Firm* — Duft & Bornsen, PC

(57) ABSTRACT

Systems and methods for evenly heating a drum dryer of a print system. In one embodiment, the dryer is configured to rotate about an axis oriented in a lateral direction, to receive a radiant energy source disposed inside the drum that extends between each lateral end of the drum in the lateral direction, and to receive a reflective assembly inside the drum that includes an inner portion and an outer portion. The inner portion surrounds the radiant energy source and removably attaches the reflective assembly to a lateral end of the drum. The outer portion extends from the inner portion in a radial direction of the drum that is perpendicular to the lateral direction. The outer portion includes a reflective surface that reflects radiant energy from the lateral end to the central portion of the drum in contact with the web.

13 Claims, 20 Drawing Sheets

(56) References Cited

U.S. PATENT DOCUMENTS

| | | | | |
|---|---|---|---|---|
| 7,187,899 | B2 | 3/2007 | Cao et al. | |
| 7,725,050 | B2 | 5/2010 | Li et al. | |
| 8,292,442 | B2 | 10/2012 | Ricks et al. | |
| 8,439,496 | B2 | 5/2013 | Naivelt et al. | |
| 8,690,310 | B1 | 4/2014 | Schmaelzle et al. | |
| 8,721,024 | B2 | 5/2014 | Leighton et al. | |
| 8,807,737 | B2 | 8/2014 | Thayer et al. | |
| 9,126,434 | B2 | 9/2015 | Jessen | |
| 9,352,588 | B1 | 5/2016 | Boland et al. | |
| 10,500,873 | B2 * | 12/2019 | Allison | B41J 11/002 |
| 2012/0287215 | A1 | 11/2012 | Boland et al. | |

* cited by examiner

REFLECTORS FOR EVENLY HEATING A DRUM DRYER OF A PRINT SYSTEM

RELATED APPLICATIONS

This document is a continuation of co-pending U.S. patent application Ser. No. 15/954,297 (filed on Apr. 16, 2018) titled, "REFLECTORS FOR EVENLY HEATING A DRUM DRYER OF A PRINT SYSTEM," which is a continuation of U.S. patent application Ser. No. 15/279,921 (filed on Sep. 29, 2016) titled, "REFLECTORS FOR EVENLY HEATING A DRUM DRYER OF A PRINT SYSTEM" (issued as U.S. Pat. No. 9,987,859 on Jun. 5, 2018), both of which are hereby incorporated by reference.

FIELD OF THE INVENTION

The invention relates to the field of printing systems, and in particular, to print drying systems.

BACKGROUND

Businesses or other entities having a need for volume printing typically use a production printer capable of printing hundreds of pages per minute. A web of print media, such as paper, is stored in the form of a large roll and unraveled as a continuous sheet. During printing, the web is quickly passed underneath printheads which discharge small drops of ink at particular intervals to form pixel images on the web. The web may then be dried and cut to produce a printed product.

Since production printers print high quality images at high speed, it is important that the drying process of the web is quick, effective, and efficient. One such drying mechanism is a hollow metal drum heated with a radiant energy source inside the drum, such as a lamp. The lamp heats the surface of the drum to a desired temperature and the web contacts the heated rotating surface of the drum to dry ink on the web at a controlled temperature. However, various environmental factors of the print system, such as the web location, ink amounts, lamp properties, and printing time may cause the surface of the drum to be heated unevenly, resulting in decreased heat efficiency and poor drying performance.

SUMMARY

Embodiments described herein provide reflectors for evenly heating a drum dryer of a print system. A reflector may be disposed at either lateral end of the drum and include an angled or curved profile that corresponds with a heat profile across the drum's rotating surface. The profile of the reflector may be altered in numerous configurations to adapt the reflector to the heat profile of the drum, improve installation/replacement of the reflector, and/or improve accessibility of the drum for maintenance operations.

One embodiment is a dryer of a printing system. The dryer includes a thermally conductive drum configured to rotate about an axis oriented in a lateral direction, and to contact a web of print media at an external circumference surface of the drum along the lateral direction for drying ink applied to the web. The drum is also configured to receive a radiant energy source disposed inside the drum that extends between each lateral end of the drum in the lateral direction, and to receive a reflective assembly inside the drum that includes an inner portion and an outer portion. The inner portion surrounds the radiant energy source and removably attaches the reflective assembly to a lateral end of the drum.

The outer portion extends from the inner portion in a radial direction of the drum that is perpendicular to the lateral direction. The outer portion includes a reflective surface that reflects radiant energy from the lateral end to the central portion of the drum in contact with the web.

Another embodiment is a dryer of a printing system that includes a thermally conductive drum configured to rotate about an axis oriented in a lateral direction, to contact a web of print media at a central portion of the drum along the lateral direction for drying ink applied to the web, and to install a radiant energy source inside the drum that extends between each lateral end of the drum in the lateral direction. The dryer also includes a reflective element at a lateral end of the drum, wherein at least a portion of the reflective element curves inward toward the radiant energy source to direct radiant energy to the central portion of the drum in contact with the web.

Yet another embodiment is a drying system for print media. The drying system includes a drum having a hollow cylindrical body that is thermally conductive and operable to install a radiant energy source inside the drum. The drying system also includes a reflective element at a lateral end of the drum that shields an end cap of the drum from the radiant energy source, the reflective element having a curved reflective surface that corresponds with heat flux exiting the cylindrical body of the drum.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, and with reference to the accompanying drawings. The same reference number may represent the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
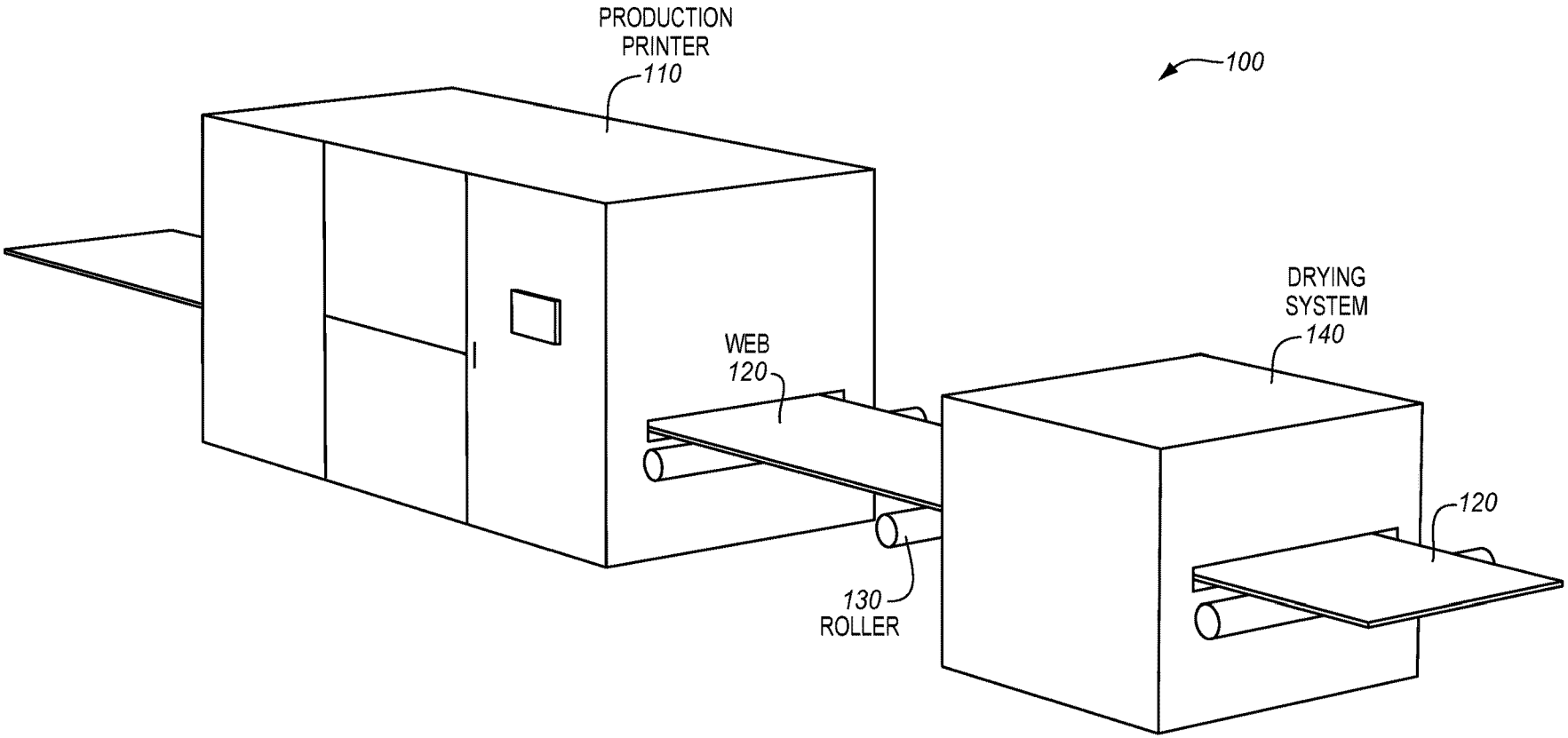
FIG. 1 illustrates an exemplary continuous-forms printing system.

FIG. 1 illustrates an exemplary continuous-forms printing system 100. Printing system 100 includes production printer 110 and drying system 140. Production printer 110 is any system or device capable of applying ink (e.g., any suitable marking fluid such as aqueous inks, oil-based paints, etc.) to a web 120 of continuous-form print media (e.g., paper). One example of production printer 110 is an inkjet printer that applies colored inks, such as Cyan (C), Magenta (M), Yellow (Y), Key (K) black, white, or colorless inks. After printing, rollers 130 transport web 120 to drying system 140 which is any system or device capable of drying ink applied to web 120. Drying system 140 may be integrated with production printer 110 or a stand-alone external drying system.

Figure 2:
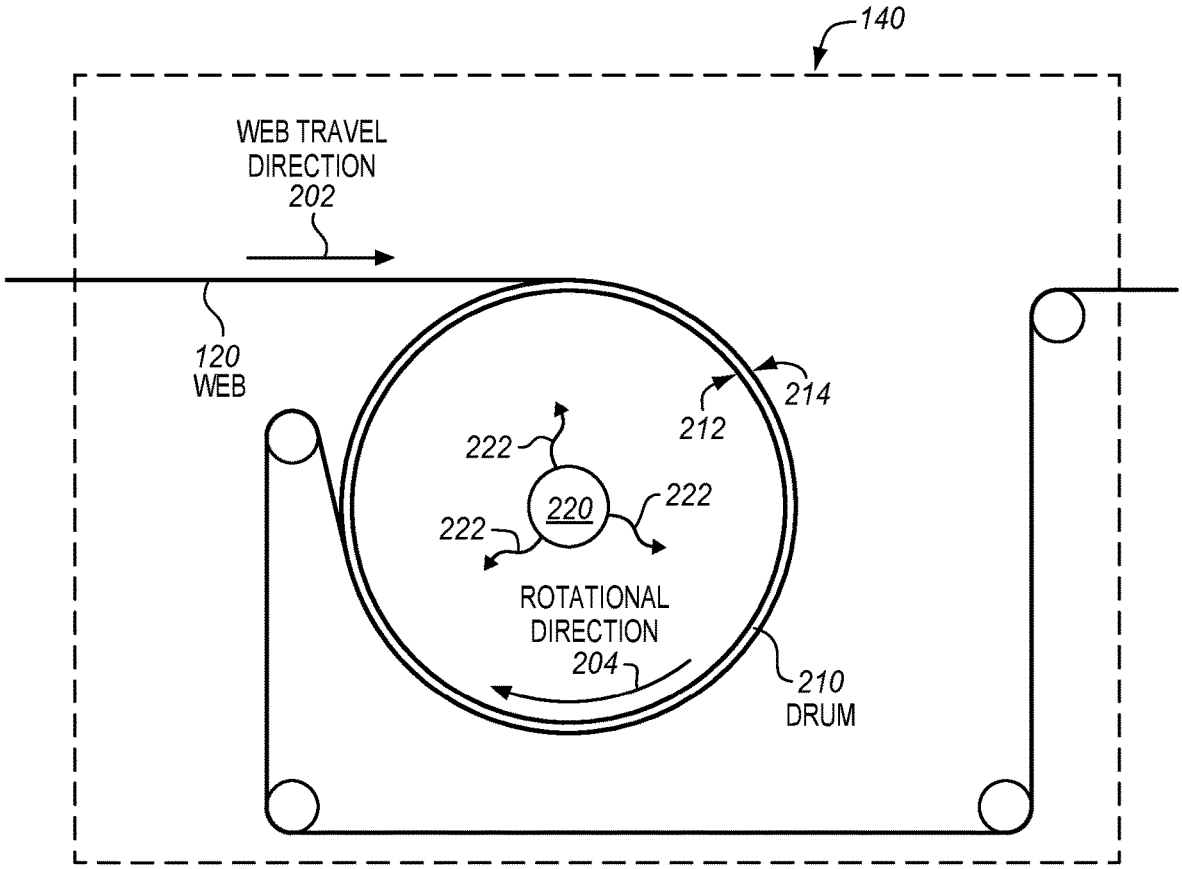
FIG. 2 illustrates a cross-sectional side view of a drying system in an exemplary embodiment.

FIG. 2 illustrates a cross-sectional side view of a drying system 140 in an exemplary embodiment. Drying system 140 includes a thermally conductive drum 210 and a radiant energy source 220 disposed inside drum 210. Drum 210 is hollow and thus includes an inner surface 212 and an outer surface 214 (e.g. exterior circumference surface). During operation, web 120 is marked with ink by a print engine, enters drying system 140 as it travels in web travel direction 202, and wraps around outer surface 214 of drum 210, which rotates in rotational direction 204 and is heated to a desired temperature via heat transfer of radiant energy 222 from radiant energy source 220. Radiant energy source 220 is any system or device capable of radiating heat to drum 210. One example of radiant energy source 220 is one or more heat lamps that emit infrared (IR) or near-infrared (NIR) energy and heat.

Figure 3:
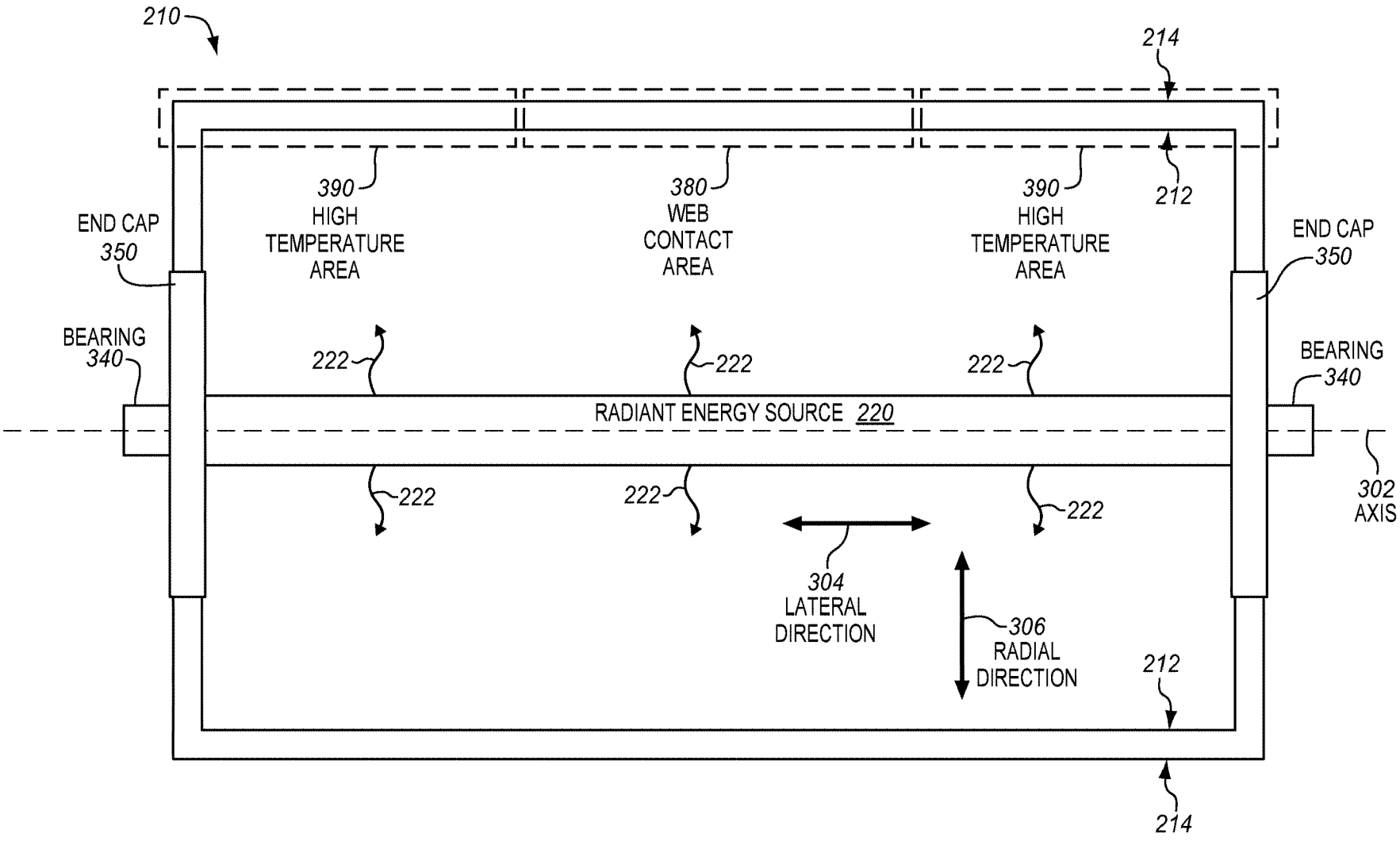
FIG. 3 illustrates a cross-sectional front view of a dryer drum in an exemplary embodiment.

FIG. 3 illustrates a cross-sectional front view of drum 210 in an exemplary embodiment. Drum 210 includes bearings 340 that support rotation of drum 210 about axis 302, and a radiant energy source 220 that extends in a lateral direction 304 between end caps 350 of drum 210. The lateral direction 304 refers to a direction that is parallel with axis 302 and perpendicular to a radial direction 306 of drum 210. Although radiant energy source 220 may emit radiant energy 222 in a relatively even distribution in lateral direction 304 of drum 210, the temperature of drum 210 along the lateral direction 304 may become uneven due to heat transferring away from drum 210 at web contact area 380. As surfaces 212/214 of drum 210 at web contact area 380 becomes relatively cool, high temperature areas 390 at or near lateral ends of drum 210 may occur and cause drying of web 120 to become imprecise and difficult to control in part because of heat transfer between high temperature area(s) 390 and web contact area 380. Additionally, high temperature areas 390 may cause excessive heat at lateral ends of drum 210, including end cap 350 and/or bearing 340, making maintenance operations difficult and resulting in energy efficiency losses during drying operations.

Figure 4:
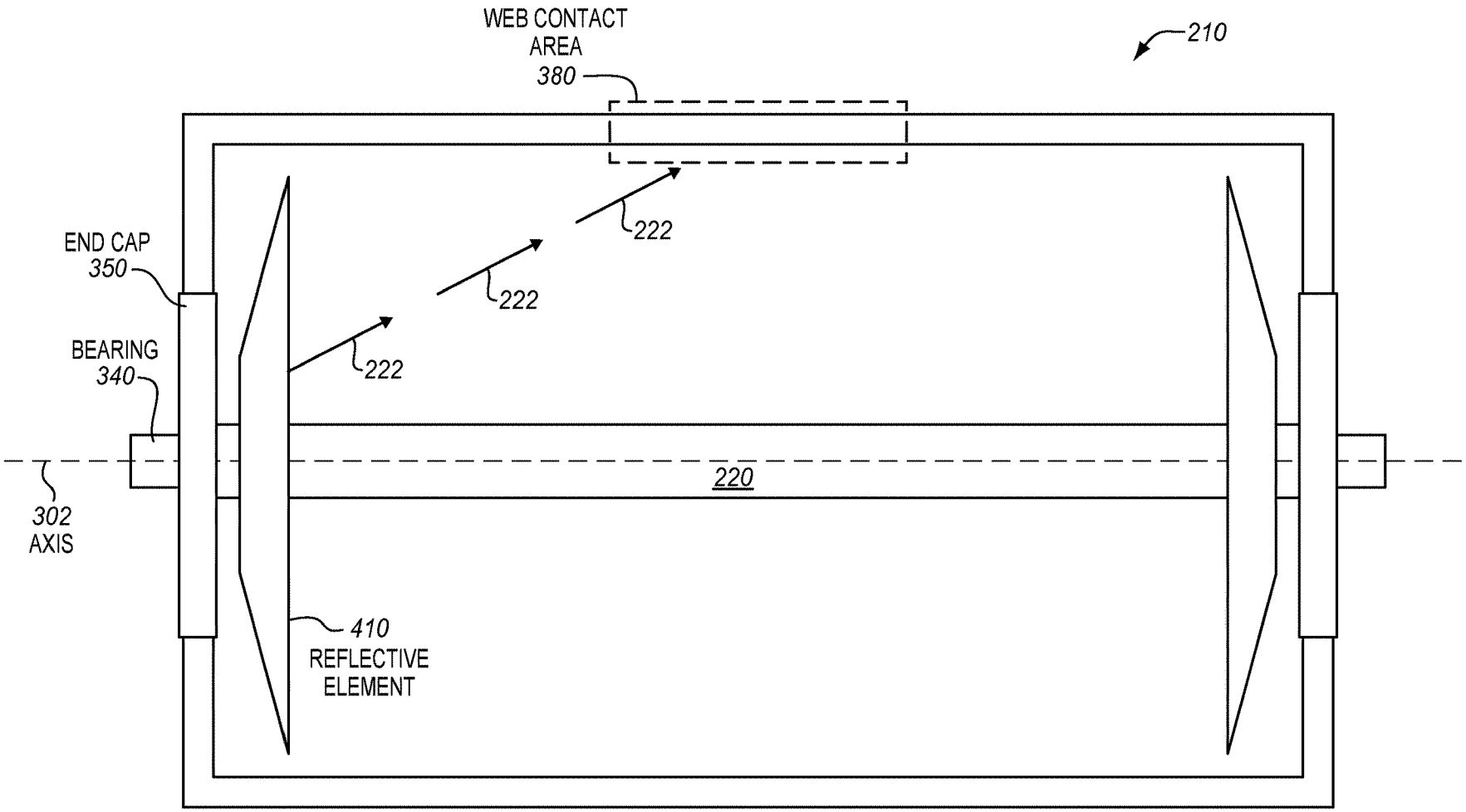
FIG. 4 illustrates a dryer drum enhanced with a reflective element in an exemplary embodiment.

To address these issues, drum 210 may be enhanced with a reflective element to redistribute heat in the lateral direction 304 of drum 210. FIG. 4 illustrates drum 210 enhanced with a reflective element 410 in an exemplary embodiment. Reflective element 410 is any system, component, or device operable to reflect radiated energy 222 of radiant energy source 220 toward inner surface 212 of drum 210 at web contact area 380. This enables the heat profile of drum 214 to be maintained in the lateral direction 304, thus improving heat control and drying performance of web 120 as well as accessibility and operating efficiency of drum 210.

In general, reflective element 410 is located inside drum 210 at one or both lateral ends to reflect heat away from the lateral end and toward web contact area 380. Web contact area 380 may comprise any exterior circumference surface portion of drum 210 along lateral direction 304 that is between far ends of drum 210 in lateral direction 304, including a center of drum 210 and/or a lateral portion that is off-center. The term lateral end may therefore refer to any area and/or any components of drum 210 located laterally between a far lateral end of drum 210 and a vertical boundary where web contact area 380 begins. Numerous details and exemplary embodiments of drum 210 and reflective element 410 are discussed below.

Figure 5:
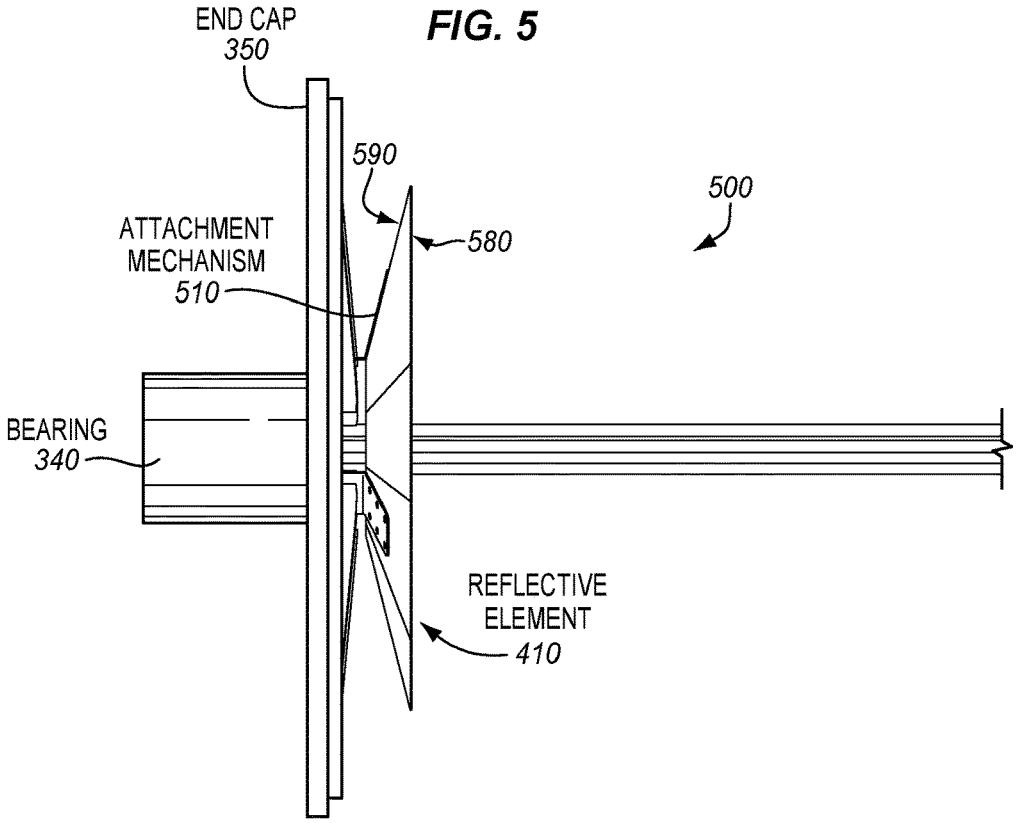
FIG. 5 illustrates a lateral end of drum with a reflective element in an exemplary embodiment.

FIG. 5 illustrates a lateral end 500 of drum 210 with reflective element 410 in an exemplary embodiment. Lateral end 500 of drum 210 includes a bearing 340, end cap 350, reflective element 410, and an attachment mechanism 510 which is any device or component(s) configured to removably attach reflective element 410 inside drum 210 at lateral end 500. Attachment mechanism 510 may include one or more plates, brackets, mounts, etc. to provide support for reflective element 410, one or more screws, rods, sockets, etc. to connect/disconnect reflective element 410 from the support, and/or one or more hinges, joints, bearings, and/or other components that enable positional and/or angular adjustment of reflective element 410 at lateral end 500 of drum 210. Accordingly, reflective element 410 may be detached, replaced and/or positioned in lateral end 500 as desired to correspond with web contact area 380 and/or the uneven heat profile of drum 210.

A front side 580 of reflective element 410 includes reflective material that directs heat to web contact area 380 and forms a thermal barrier between radiant energy source 220 and components of lateral end 500 behind a back side 590 of reflective element 410. Thus, with respect to lateral direction 304, reflective element 410 is disposed in front of end cap 350 and may comprise any shape, size, and/or alignment within drum 210 to cover or substantially cover end cap 350 and/or end wall of drum 210. Attachment mechanism 510 may directly or indirectly connect reflective element 410 to the drum 210 and/or one or more components of drum 210 at lateral end 500, including end cap 350, bearing 340, an inner circumferential wall 212 of drum 210, and/or an end wall of drum 210.

Figure 6:
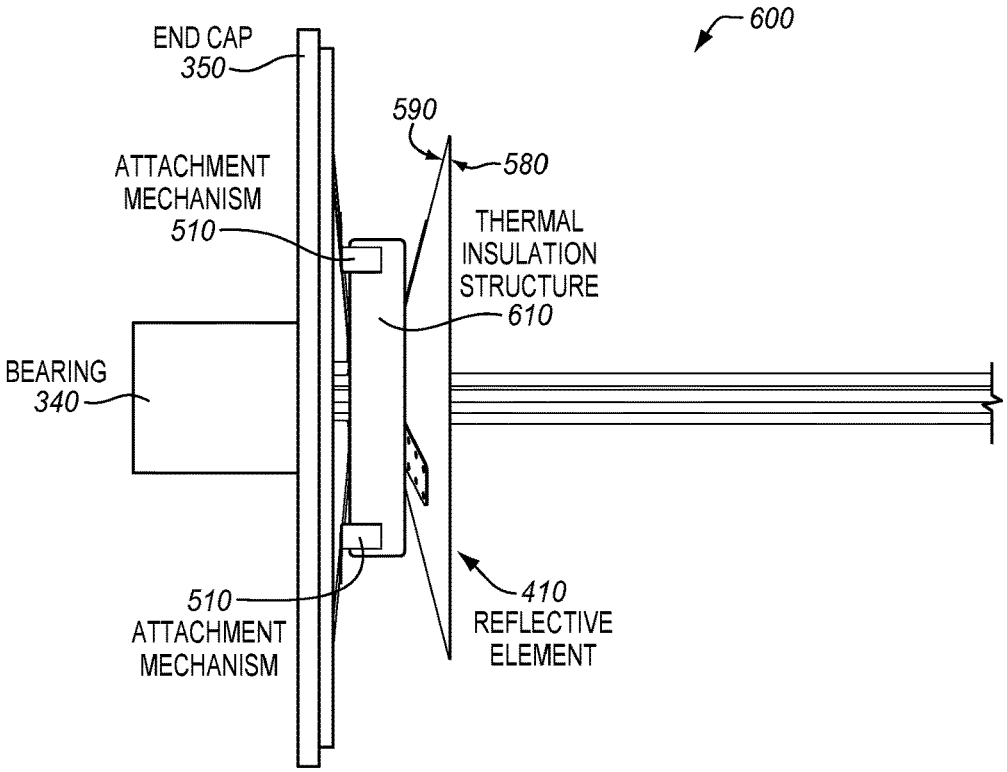
FIG. 6 illustrates a lateral end of a drum with a reflective element in another exemplary embodiment.

FIG. 6 illustrates a lateral end 600 of drum 210 with reflective element 410 in another exemplary embodiment. Lateral end 600 includes a thermal insulation structure 610 disposed between reflective element 410 and the drum 210 and/or one or more components of drum 210 at lateral end 600, including end cap 350 and/or bearing 340. Thermal insulation structure 610 may include any material having relatively low thermal conductivity (e.g., ceramic, polytetrafluorethylene (PTFE) (e.g., Teflon), etc.) to reduce conducted heat transfer between components of lateral end 600 or to thermally isolate such components from radiant energy source 220. Thermal insulation structure 610 may include one or more attachment mechanism(s) 510 that connect thermal insulation structure 610 to drum 210 and/or one or more components of drum 210 at lateral end 600, including bearing 340, end cap 350, and/or reflective element 410. Alternatively or additionally, thermal insulation structure 610 may be fixedly attached, integrated with, and/or comprise entire or portions of one or components at lateral end 600.

Figure 7:
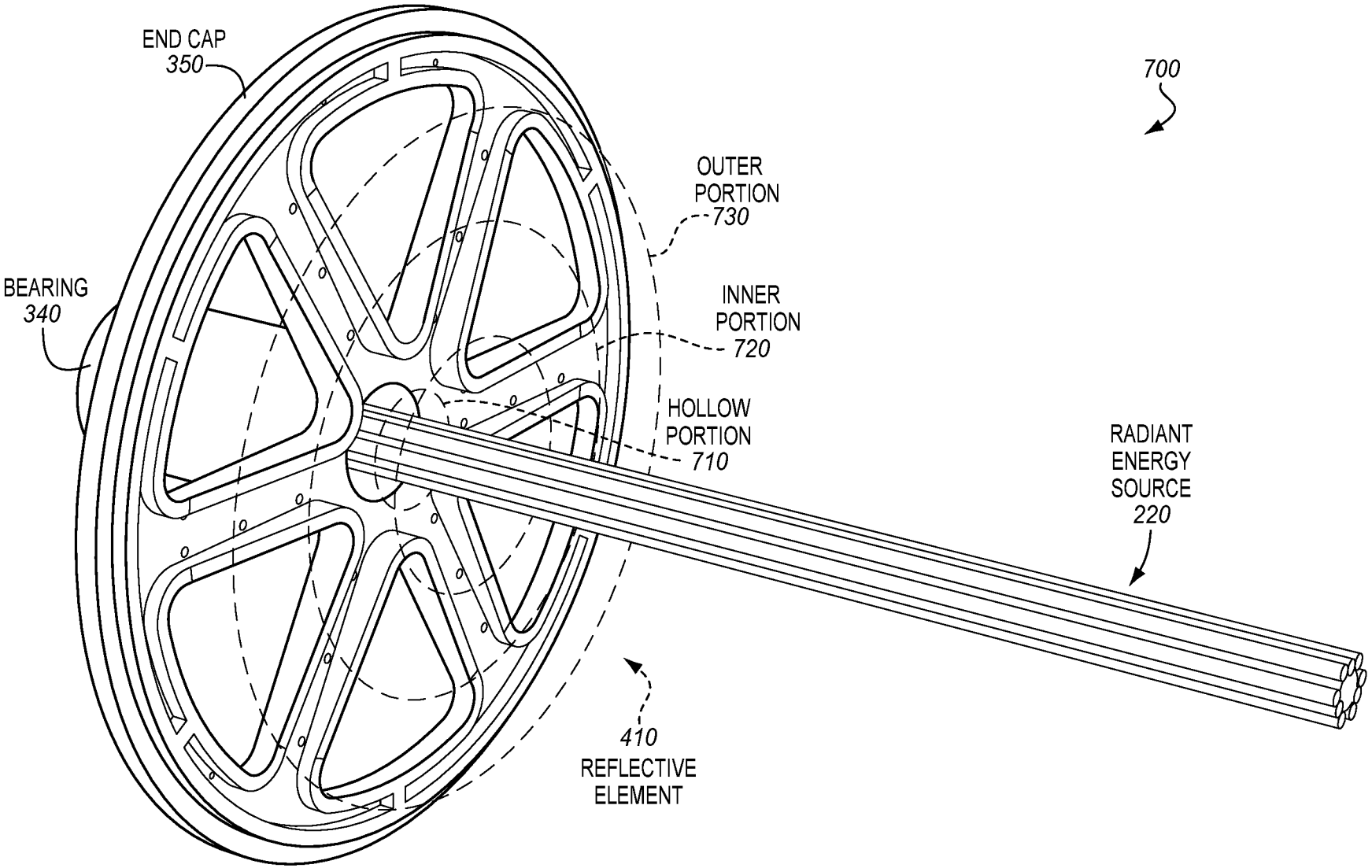
FIG. 7 illustrates a perspective view of lateral end of a drum with a reflective element in an exemplary embodiment.

FIG. 7 illustrates a perspective view of lateral end 700 of drum 210 with reflective element 410 in an exemplary embodiment. In this example, reflective element 410 includes a hollow portion 710, an inner portion 720, and an outer portion 730. Hollow portion 710 defines an empty and/or indented space in reflective element 410 in the lateral direction 304. Thus, radiant energy source 220 may extend through reflective element 410 to end cap 350 and/or bearing 340 for support at either side of drum 210. Inner portion 720 may include a reflective material, a thermal insulation structure 610, or some combination thereof, that forms a perimeter around hollow portion 710 and which may surround radiant energy source 220 in a circumferential direction. Outer portion 730 may include a reflective material extending in the radial direction 306 of drum 210 toward inner surface 212 (e.g., interior circumference) of drum 210 to cover or substantially cover end cap 350 and/or the end wall of drum 210.

Portions 720/730 of reflective element 410 may individually or collectively include a reflective surface having multiple different reflection angles and/or a curved reflective surface. For example, portions 720/730 may include a surface that, for some distance in radial direction 306, curves inward toward radiant energy source 220 in lateral direction 306 to form a concave shape that directs radiant energy 222 within drum 210 to web contact area 380. Accordingly, portions 720/730 at front side 580 of reflective element 410 may form a variable reflective surface that curves or has multiple angles of reflection corresponding to the variations of heat flux exiting drum 210 along lateral direction 304.

Inner portion 720 and/or outer portion 730 of reflective element 410 may comprise a continuous (e.g., a single solid and/or monolithic structure), contiguous, or segmented surface that has a rotational symmetry with respect to axis 302. When viewed along lateral direction 304, reflective element 410 may comprise a shape which, if rotated about its center point, includes multiple matching points in a single rotation. In other words, reflective element 410, including inner portion 720 and/or outer portion 730, may comprise a solid or segmented shape with a rotational symmetry order of N, where N is greater than or equal to two. Examples of such a shape include, but are not limited to, a circular shape, a hexagonal shape, a fan/pedal shape, etc. Reflective element 410, end cap 350, radiant energy source 220, thermal insulation structure 610, and/or other components at lateral end 700 may rotate with drum about axis 302 or an axis parallel to axis 302, or may be rotationally fixed as desired.

Figure 8:
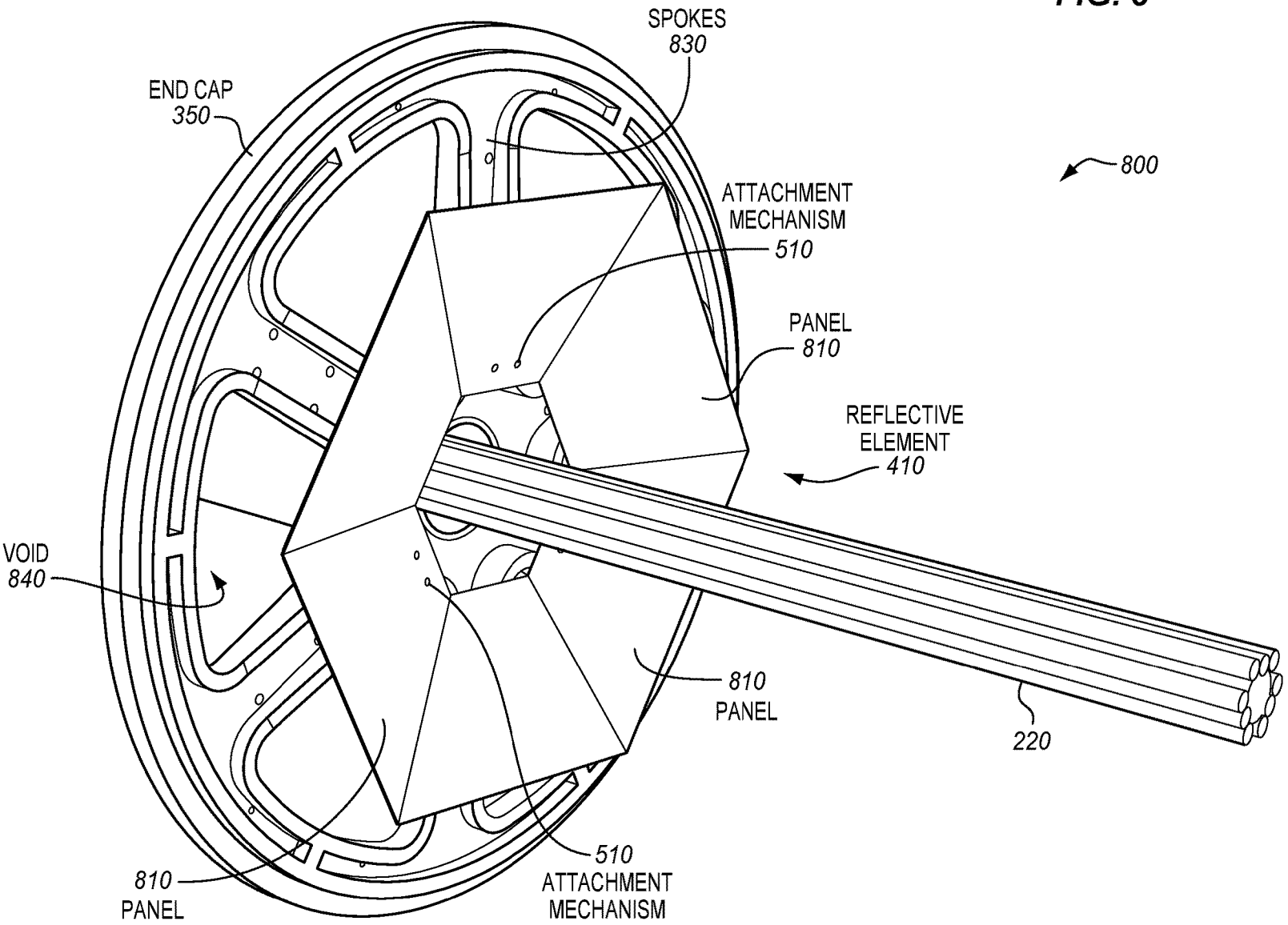
FIG. 8 illustrates a perspective view of a reflective element with multiple panel segments at a lateral end of a drum in an exemplary embodiment.

FIG. 8 illustrates a perspective view of a reflective element 410 with multiple panel 810 segments at a lateral end 800 of drum 210 in an exemplary embodiment. Each panel 810 of reflective element 410 may include reflective material and an attachment mechanism 510 for removably attaching panels 810 to end cap 350, bearing 340, and/or other panels 810. Removable panels 810 may be useful for installing, replacing, and/or configuring reflective panel 410 within drum 210. For example, end cap 350 may be removed or uncovered to allow access inside drum 210 via voids 840 between spokes 830 that structurally support drum 210 at lateral end 800. During operation of drum 210, panels 810 may collectively form a contiguous surface that surrounds radiant energy source 220 circumferentially at inner portion 720, extends in the radial direction 306 to substantially cover end cap 350 at outer portion 730, and which tilts toward radiant energy source 220 from inner portion 720 to outer portion 730 to form a cup or concave-type shape of any desired shape, including flat and/or curved surfaces. Additionally, each panel 810 may be removed, replaced, and/or adjusted as needed for maintenance operations that access drum 210 via void(s) 840 without removing entire end cap 350 or other structural support of drum 210 at lateral end 800.

Figure 9:
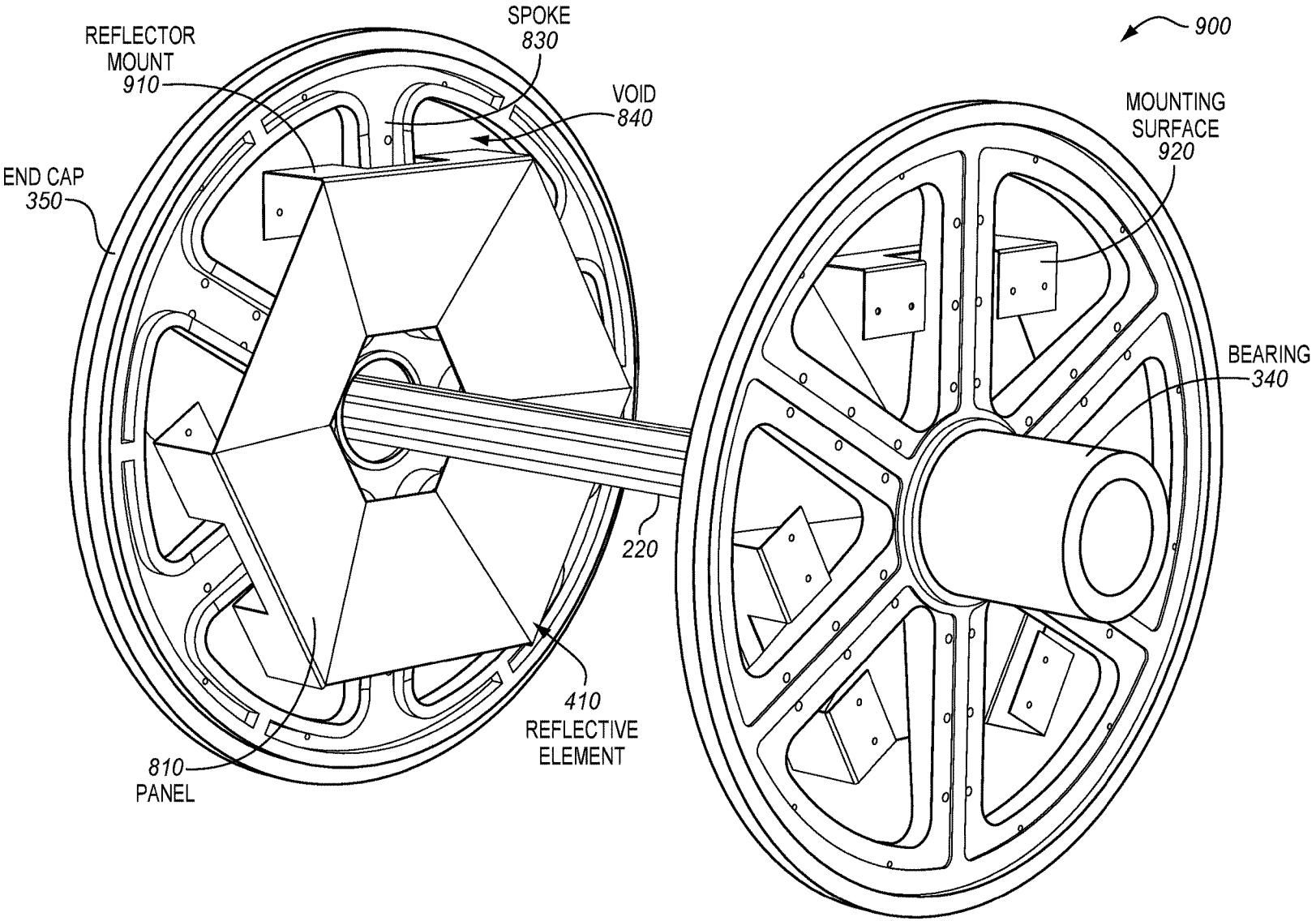
FIG. 9 illustrates a perspective view of a drum with a reflective element having segmented panels, a reflector mount, and mounting surface in an exemplary embodiment.

FIG. 9 illustrates a perspective view 900 of drum 210 with reflective element 410 having segmented panels 810, a reflector mount 910, and mounting surface 920 in an exemplary embodiment. Reflector mount 910 of panel 810 extends in lateral direction 304 to support outer perimeter of reflective element 410. Each panel 810 may additionally include one or more mounting surfaces 920 that include attachment mechanism(s) 510 for removably attaching panel 810 to end cap 350 and/or other component at the lateral end of drum 210. Reflector mount 910 and/or mounting surface 920 may include thermal insulation structure 610 material to reduce heat transfer at the lateral end of drum 210. Additionally, reflector mount 910 may include an indentation for securing panel 810 around spoke 830 in lateral direction 304, and mounting surface 920 may extend perpendicularly to reflector mount 910 to face and/or align with voids 840 for convenient access to drum 210 and reflective element 410.

Figure 10:
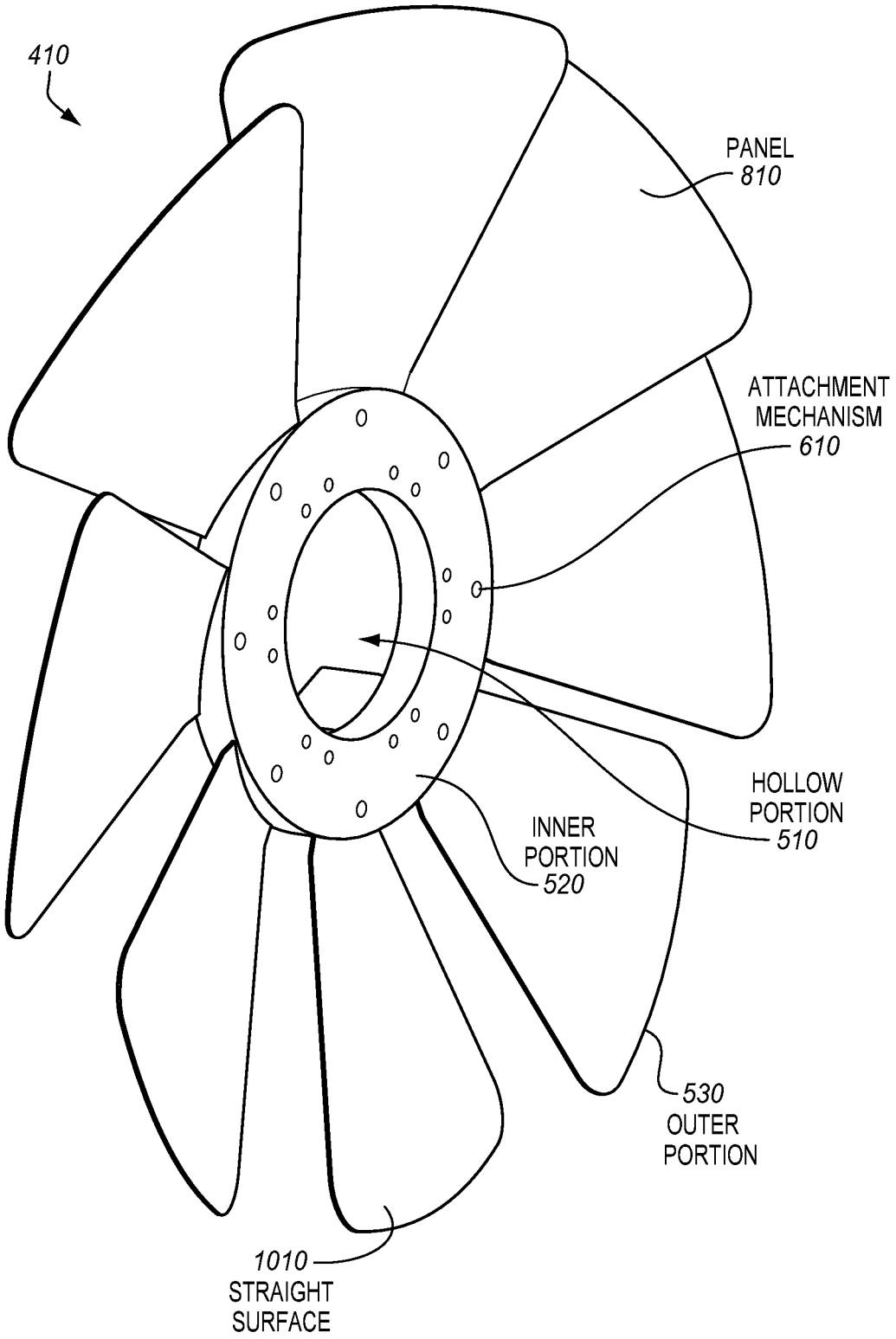
FIG. 10 illustrates a perspective view of reflective element 410 with segmented panels 810 in an exemplary embodiment

FIG. 10 illustrates a perspective view of reflective element 410 with segmented panels 810 in an exemplary embodiment. In this example, panels 810 comprise separate boards having a straight surface 1010 of reflective material. Base ends of panels 810 may attach around the outer perimeter of inner portion 520 in a circumferential direction. Edges of adjacent panels 810 may abut the edge a neighboring panel 810, be separated by a non-zero distance, or both, as panels 810 extend from base end to distal end. Panels 810 may also attach at non-zero angles with respect to radial direction 306 such that adjacent edges of panels 810 overlap when viewed in the lateral direction 304 as panels 810 extend from base end to distal end. Accordingly, panels 810 may help circulate air and evenly distribute heat in drum 210 during rotation.

Figure 11:
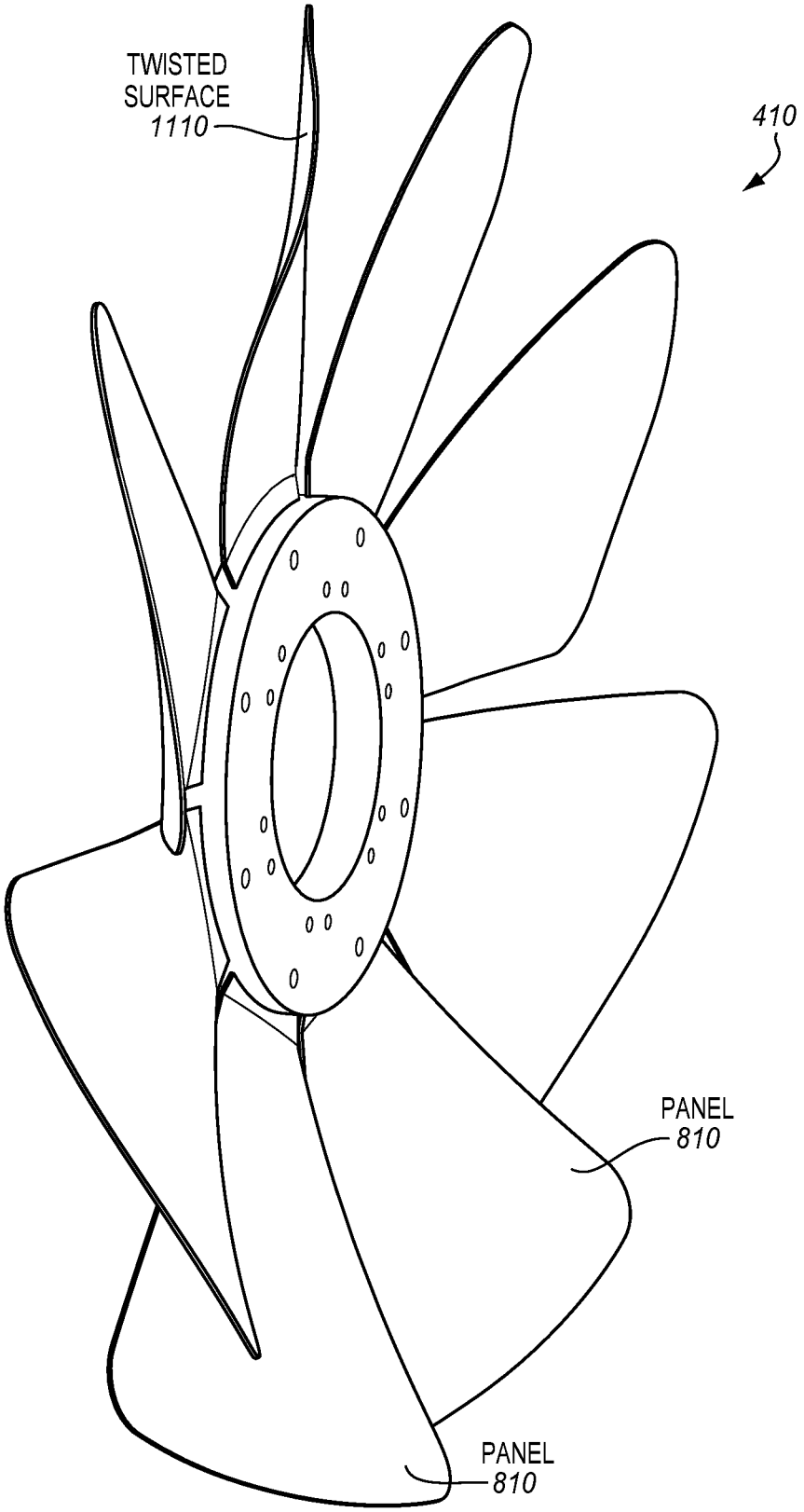
FIG. 11 illustrates a perspective view of a reflective element with segmented panels in another exemplary embodiment.

FIG. 11 illustrates a perspective view of reflective element 410 with segmented panels 810 in another exemplary embodiment. To further circulate air and distribute heat in drum 210, panels 810 may include a twisted surface 1110 of front-facing reflective material. That is, as panels 810 extend from base end to distal end, either edge of panel 810 twists or curves in different direction with respect to the lateral direction 304. Numerous fan blade type shapes of panels 810 are possible, including forward/backward curves, radial blades, propeller type blades, leaf type blades, etc. Thus, panels 810 may be shaped to direct heat to web contact area 380 and also shaped to circulate hot air to further help even the heat distribution inside drum 210.

Figure 12B:
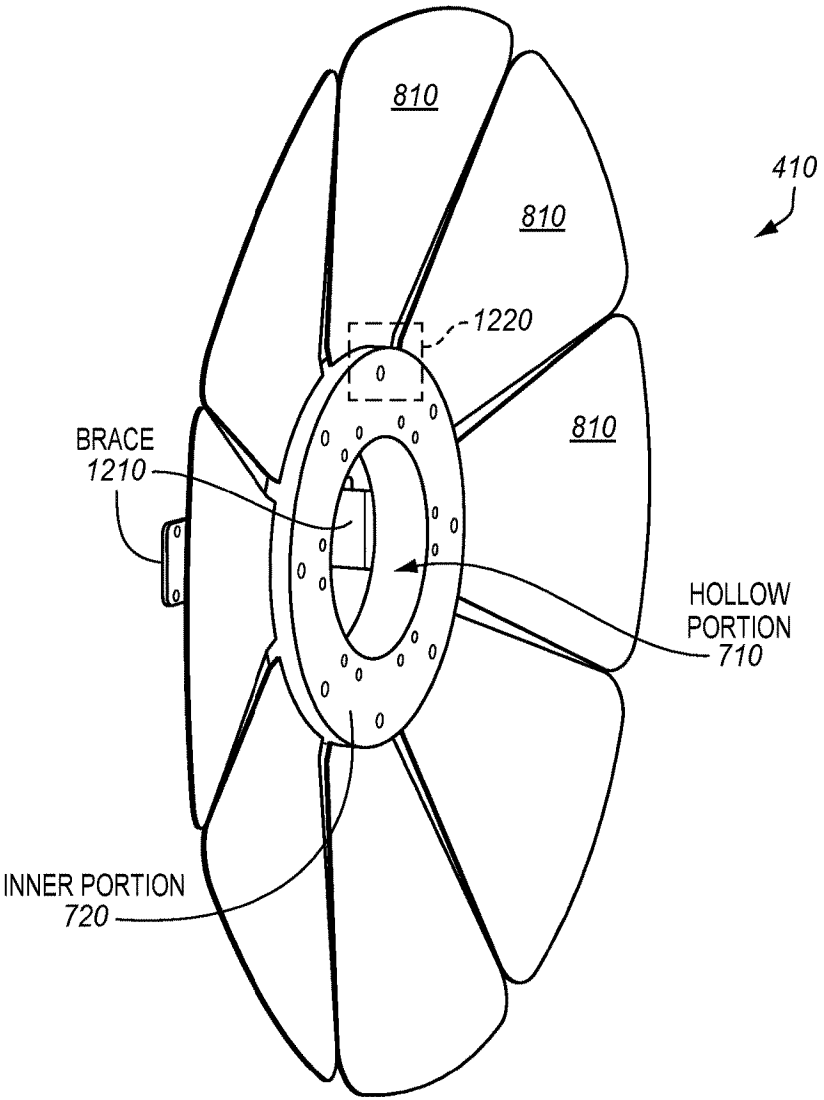
FIG. 12B illustrates a perspective view of a reflective element with segmented panels in yet another exemplary embodiment.
Figure 12A:
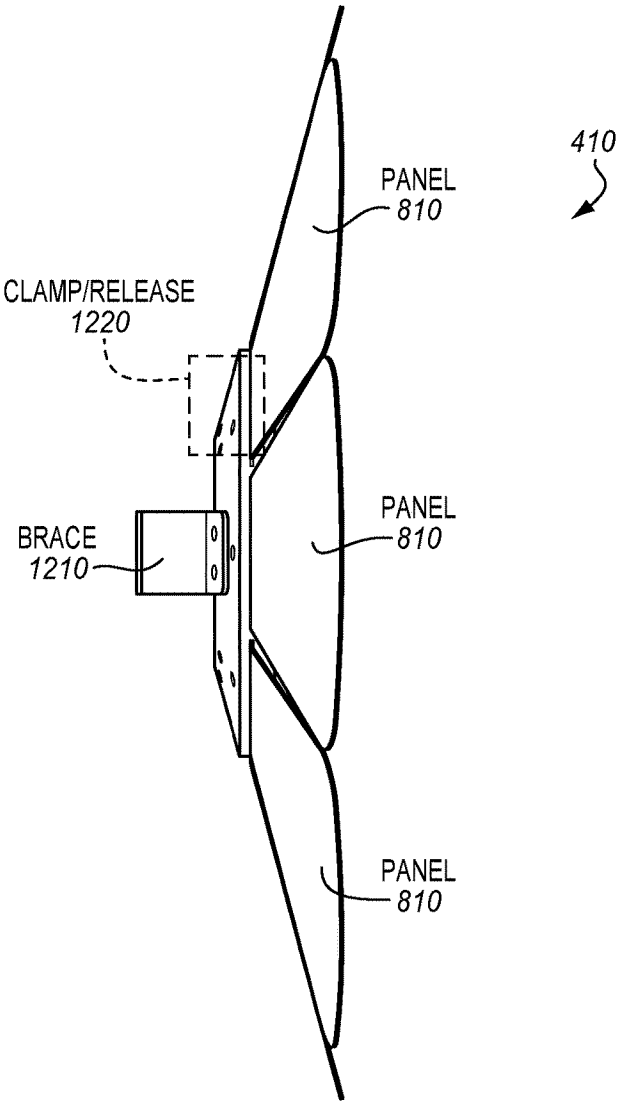
FIG. 12A illustrates a side view of a reflective element with segmented panels in another exemplary embodiment.

FIG. 12A illustrates a side view of reflective element 410 with segmented panels 810 in another exemplary embodiment. Reflective element 410 may include a brace 1210 attached to a lateral end of drum 210 such as end cap 350 and that supports a clamp/release mechanism 1220 configured to quickly attach/detach panels 810 of reflective element 410. In that regard, brace 1210 and/or inner portion 720 of reflective element 410 may include grooves or slots shaped to receive base ends of panels 810 which may in turn include notches or hollow space for clamp/release mechanism 1220 to grip. For example, clamp/release mechanism 1220 may include one or more cams, rods, springs, or other components to secure panel 810 to brace 1210 via mechanical force applied to an appropriately aligned panel 810. Clamp/release mechanism 1220 may alternatively or additionally include one or more buttons, handles, levers, or other components which may be manually toggled to discharge panel 810 from brace 1210 or otherwise free panel 810 for removal via appropriate mechanical force.

FIG. 12B illustrates a perspective view of reflective element 410 with segmented panels 810 in yet another exemplary embodiment. As shown in this example, brace 1210 and/or clamp/release mechanism 1220 may be integrated with inner portion 720 of reflective element 410. For example, inner portion 720 may comprise thermal insulation structure 610 that is circular with an inner perimeter around hollow portion 710 and an outer perimeter which includes clamp/release mechanisms 1220 around its circumference for removably attaching panels 810. Alternatively or additionally, clamp/release mechanism 1220 may be configured to swivel in a circular and/or back and forth direction with respect to the lateral direction 304 to alter the angle of attachment of panel 810 in drum 210. For instance, clamp/release mechanism 1220 may include a rotatable ball joint that receives the base end of panel 810 and which may be locked/unlocked at various positions so that heat distribution of drum 210 may be altered by manipulating angles/positions of individual panel 810 as desired.

Figure 13:
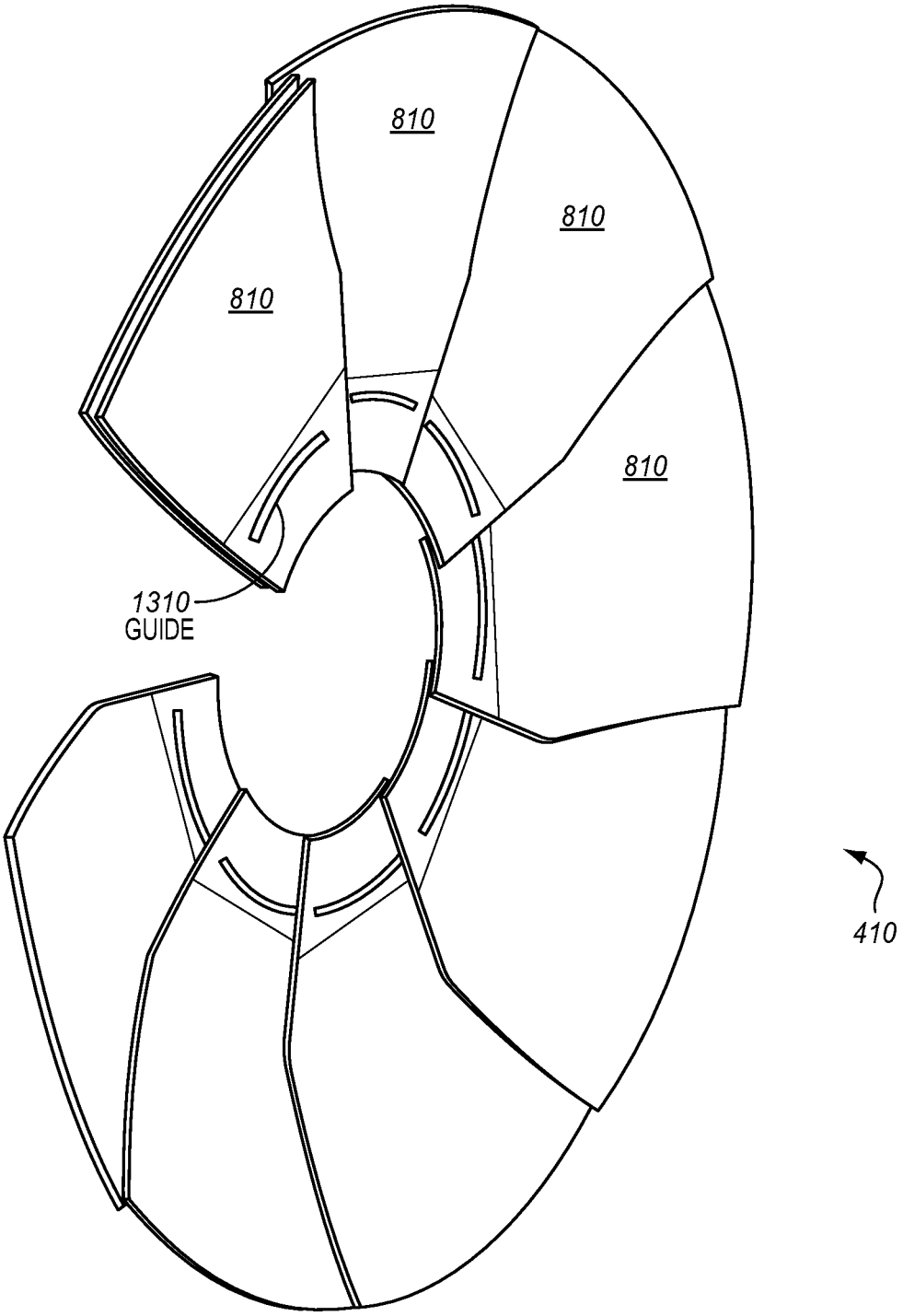
FIG. 13 illustrates a perspective view of a reflective element with collapsible segmented panels in an exemplary embodiment.

FIG. 13 illustrates a perspective view of a reflective element 410 with collapsible segmented panels 810 in an exemplary embodiment. Each panel 810 may include a guide 1310 or hollow groove that supports retraction/expansion of reflective element 410 inside drum 210. Guides 1310 may collectively form a path at inner portion 720 of reflective element 410 that enables panels 810 to overlap and slide over one another in a circumferential direction. Guides 1310 may be implemented in reflective panel 410 in combination with other components described herein, including attachment mechanism(s) 610, braces 1210, clamp/release mechanism(s) 1220, etc. Collapsible segmented panels 810 may aid in removal/installation of reflective element 410 or otherwise improve accessibility of drum 210 for maintenance operations.

Figure 14:
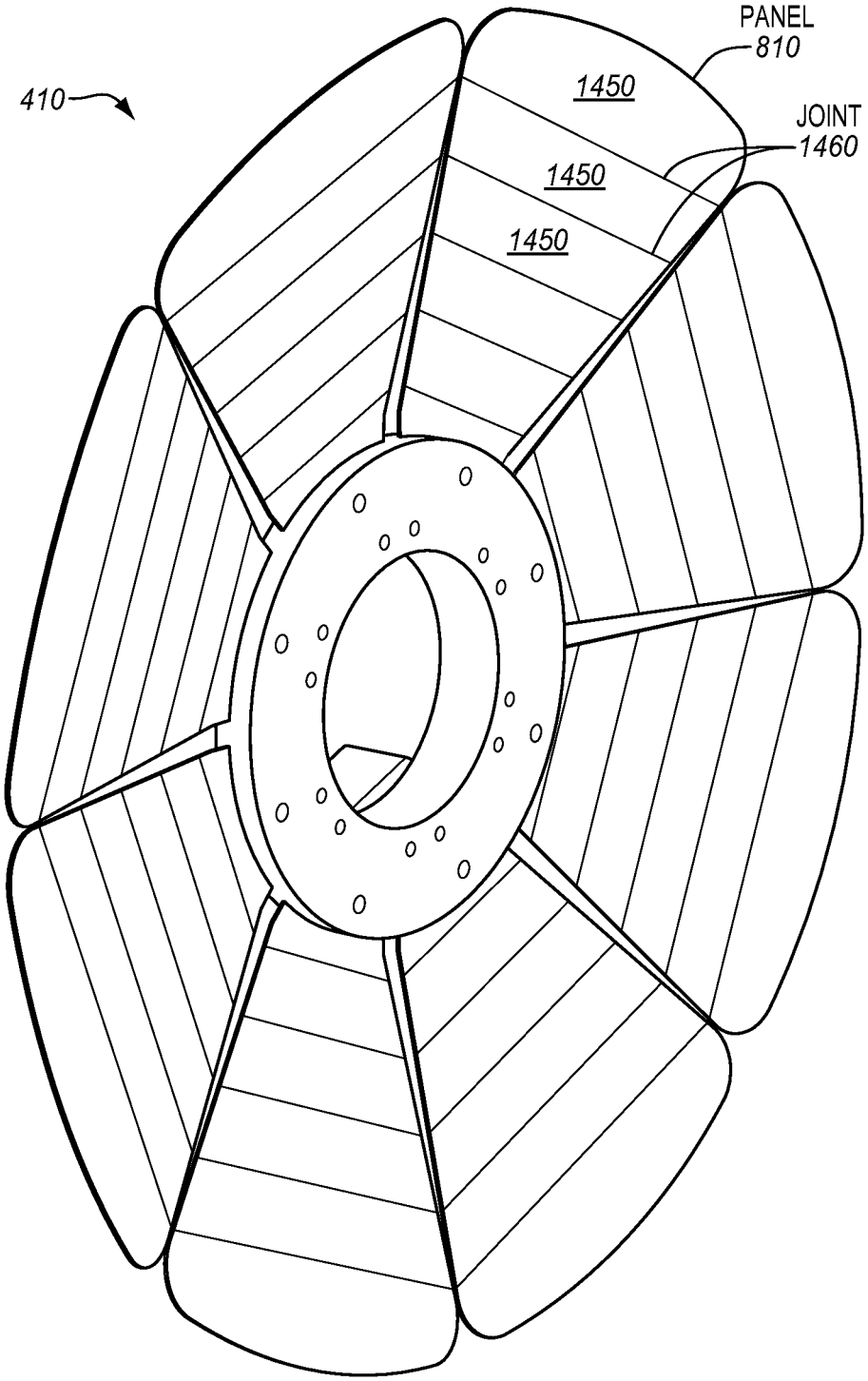
FIG. 14 illustrates a perspective view of a reflective element with panels having multiple jointed sections in an exemplary embodiment.

FIG. 14 illustrates a perspective view of a reflective element 410 with panels 810 having multiple jointed sections 1450 in an exemplary embodiment. Each panel 810 may include multiple sections 1450 connected to one another via joints 1460. Joints 1460 may include hinges or other types of components that rotate about an axis for angular adjustment of individual sections 1450 in panel 810. Although axes of joints 1460 are shown as being perpendicular to the radiation direction 306, it will be appreciated that other types of angular adjustments, rotational directions, and shapes of sections 1450 are possible. For example, reflective element 410 may comprise a continuous surface or segmented surface with a moldable or bendable reflective surface or portion of the reflective surface. Accordingly, the reflection profile of reflective element 410 may be adjusted as desired for appropriate redirection of heat in drum 210.

Figure 15A:
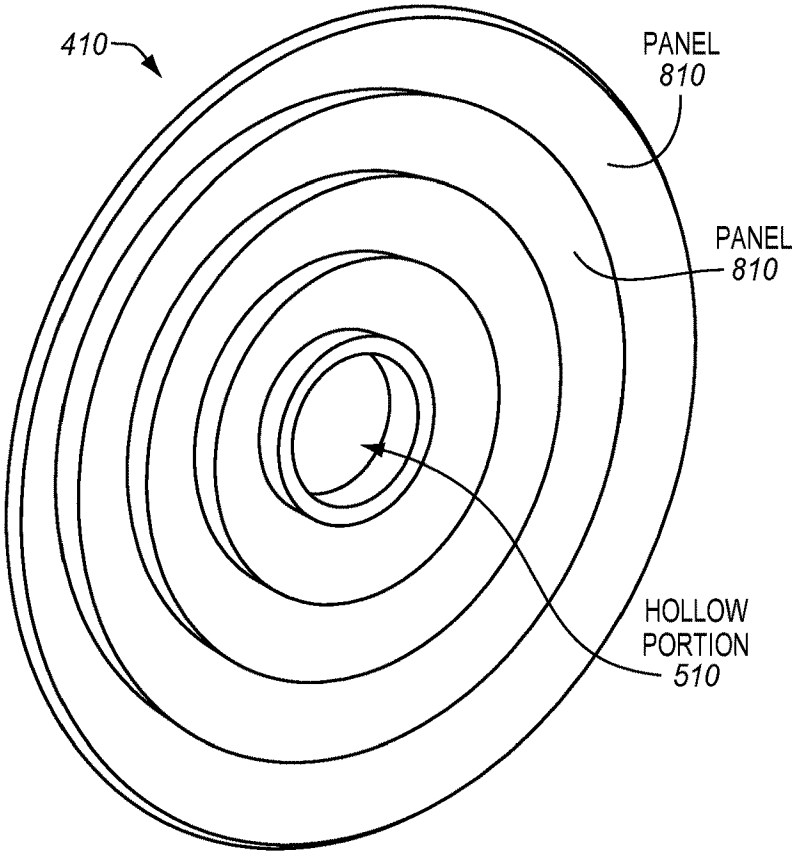
FIG. 15A illustrates a perspective view of a reflective element with circumferentially segmented panels in an exemplary embodiment.
Figure 15B:
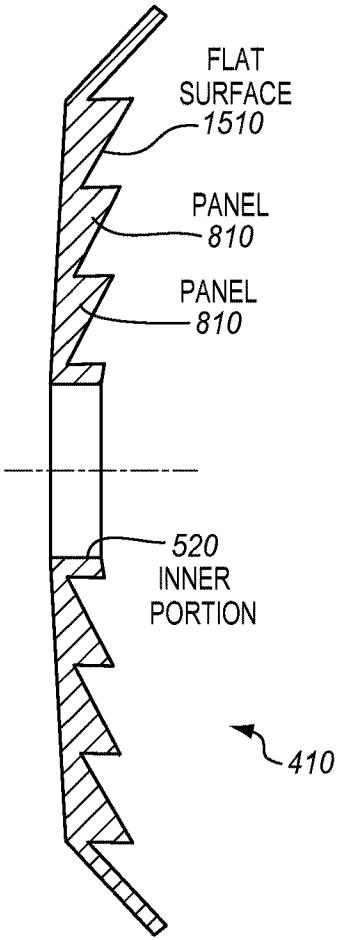
FIG. 15B illustrates a cross-sectional side view of a reflective element with circumferentially segmented panels having flat surfaces in an exemplary embodiment.
Figure 15C:
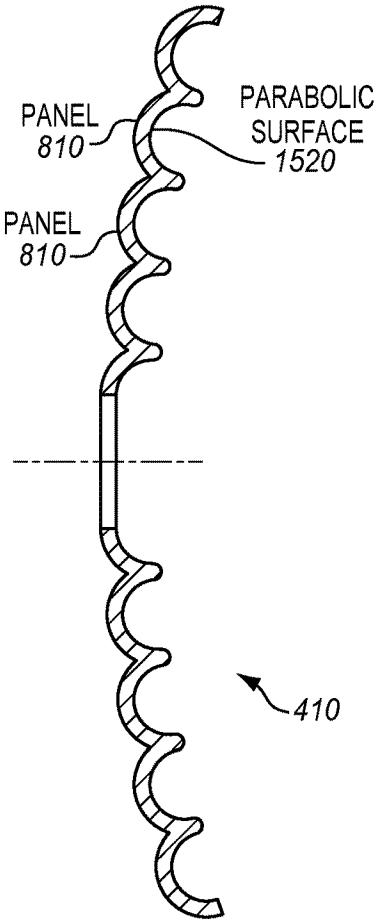
FIG. 15C illustrates a cross-sectional side view of a reflective element with circumferentially segmented panels having parabolic surfaces in an exemplary embodiment.

FIG. 15A illustrates a perspective view of reflective element 410 with circumferentially segmented panels 810 in an exemplary embodiment. As reflective element 410 extends in the radial direction 306 from hollow portion 510 toward inner walls of drum 210, each panel 810 circumferentially surrounds an inner adjacent panel 810 in a concentric fashion. FIG. 15B illustrates a cross-sectional side view of reflective element 410 with circumferentially segmented panels 810 having flat surfaces 1510 in an exemplary embodiment. FIG. 15C illustrates a cross-sectional side view of a reflective element 410 with circumferentially segmented panels 810 having parabolic surfaces 1520 in an exemplary embodiment. Each panel 810 may be independently adjusted, have differently angled/positioned reflective surfaces from one another, and/or separate attachment mechanisms 610 for configurability of reflective element 410 and adaptation to heat profile of drum 210.

Figure 16A:
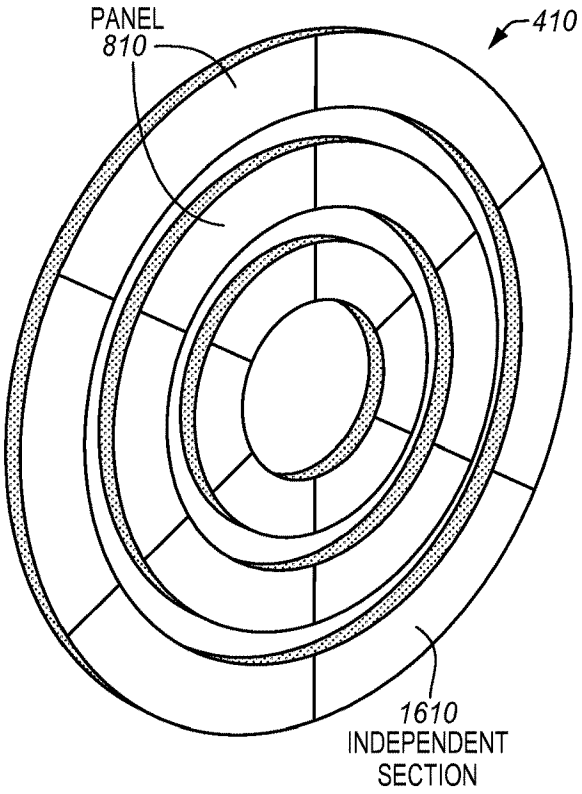
FIG. 16A illustrates a perspective view of a reflective element with circumferentially segmented panels and independent sections in an exemplary embodiment.

FIG. 16A illustrates a perspective view of reflective element 410 with circumferentially segmented panels 810 and independent sections 1610 in an exemplary embodiment. Each circumferential panel 810 may include multiple independent sections 1610 with separate attachment mechanisms 610 and/or separate adjustability. Independent sections 1610 may be implemented with circumferential panels 810 as shown in FIG. 16A or in conjunction with alternative panel 810 and/or reflective element 410 configurations as desired.

Figure 16B:
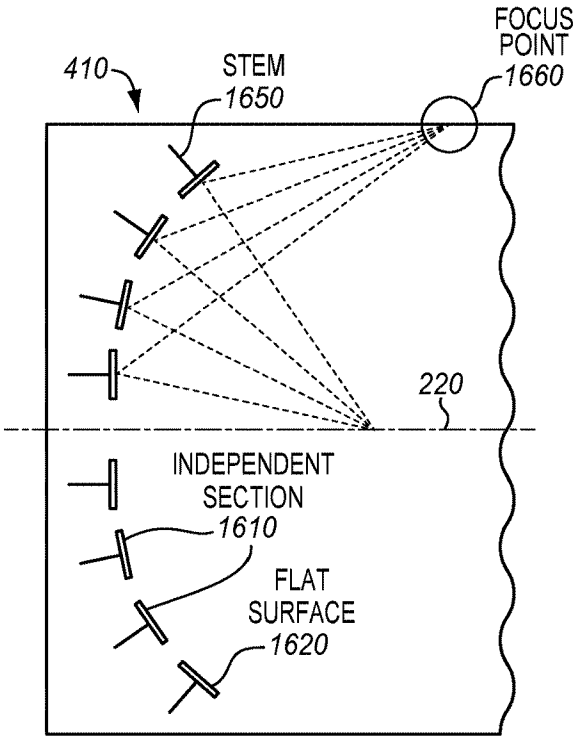
FIG. 16B illustrates a cross-sectional side view of a reflective element with independent sections and flat surfaces in an exemplary embodiment.
Figure 16C:
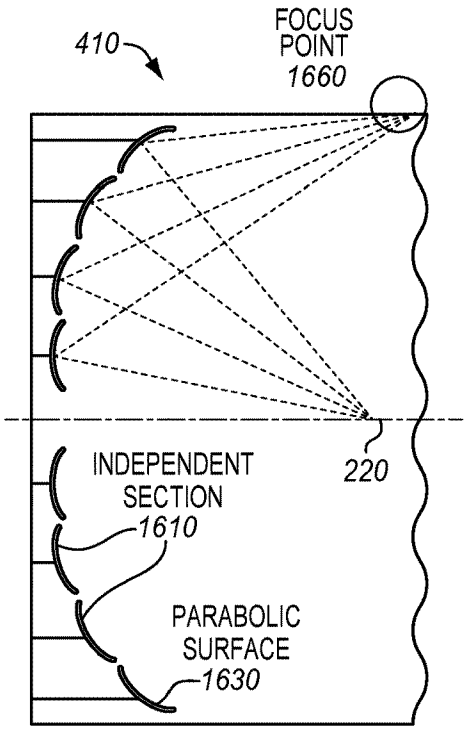
FIG. 16C illustrates a cross-sectional side view of a reflective element with independent sections and parabolic surfaces in an exemplary embodiment.

FIG. 16B illustrates a cross-sectional side view of reflective element 410 with independent sections 1610 and flat surfaces 1620 in an exemplary embodiment. FIG. 16C illustrates a cross-sectional side view of reflective element 410 with independent sections 1610 and parabolic surfaces 1630 in an exemplary embodiment. Accordingly, each independent section 1610 may be independently adjusted, have differently angled/positioned reflective surfaces from one another, and/or directly or indirectly connect to separate attachment mechanisms 610 for configurability of reflective element 410 and adaptation to heat profile of drum 210. For instance, stems 1650 may include attachment mechanism(s) 610 and/or clamp/release mechanism(s) 1220 to attach with independent sections 1610 and/or the lateral end of drum 210, such as an inner circumferential wall of drum 210 and/or an end wall or end cap 350 of drum 210. Either or both points of attachment may include one or more joints, ball bearings, or other rotation components to support altering an angle of the reflective surface. Alternatively or additionally, stem 1650 may be configured to attach at various locations inside drum 210 and/or extend/retract, bend, angle, and/or position while attached in drum 210 to increase an amount of heat radiated from radiant energy source 220 directed to a focus point 1660 or web contact area 380 along the surface of drum 210.

Figure 17:
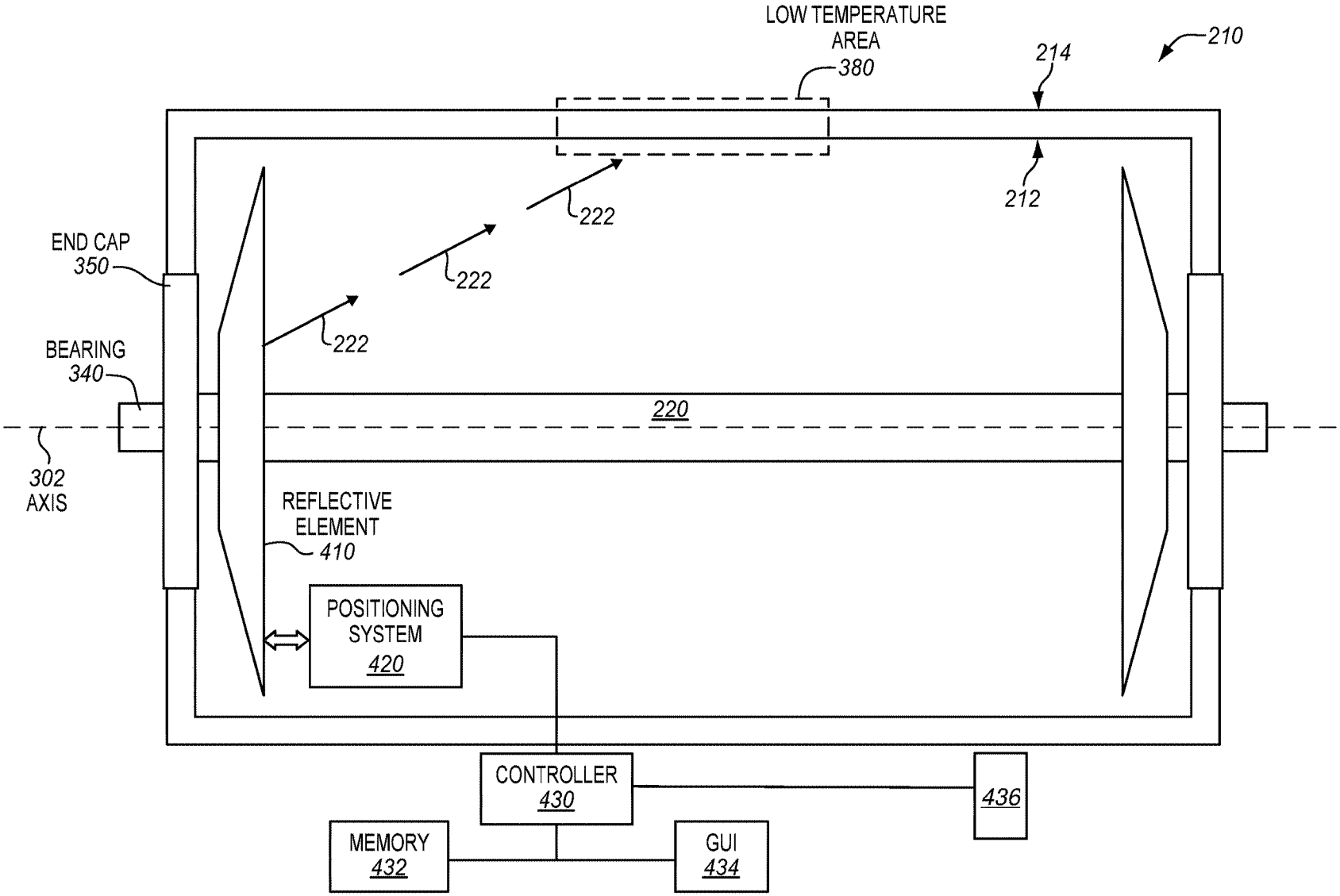
FIG. 17 illustrates a drum enhanced with a positioning system in an exemplary embodiment.

FIG. 17 illustrates a drum 210 enhanced with a positioning system 420 in an exemplary embodiment. Positioning system 420 may comprise any system, component, or device operable to apply forces to reflective element 410 for adjusting its position and/or angle of reflection of radiant energy 222 inside drum 210. Exemplary components of positioning system 420 include, but is not limited to, a pneumatic device, a hydraulic device, a motor, an electric linear actuator, etc. Positioning system 420 may dynamically adjust one or more components described herein that directly or indirectly connects with reflective element 410 and/or a portion of reflective element 410, such as panel(s) 810, attachment mechanism(s) 610, clamp/release mechanisms(s) 1220, segment(s) 1450, joint(s) 1460, independent section(s) 1610, stem(s) 1650, etc.

Drum 210 (or printing system 100 and/or drying system 140) may further include a controller 430 operable to direct positioning system 420 based on an input. For example, printing system 100 and/or drying system 140 may include a graphical user interface (GUI) 434 operable to receive input for adjusting one or more reflective element(s) 410 and/or panel(s) 810 in drum 210. Alternatively or additionally, one or more sensors 436 disposed in or around drum 210 may be operable to detect temperature(s) at one or more lateral locations of drum 210 and/or web contact area 380 and provide heat/location information to controller 430 for appropriate heat reflection adjustment in drum 210. Controller 430 may further be communicatively coupled with memory 432 operable to store instructions for adjusting reflective element 410 and/or correlations between positions of reflective element 410 with one or more variables such as a current and/or desired temperature of drum 210, web 120 properties (e.g. width, thickness, marked images, etc.), ink properties, printing mode, etc. Additional details for operations of controller 430 and positioning system 420 are described below.

Figure 18:
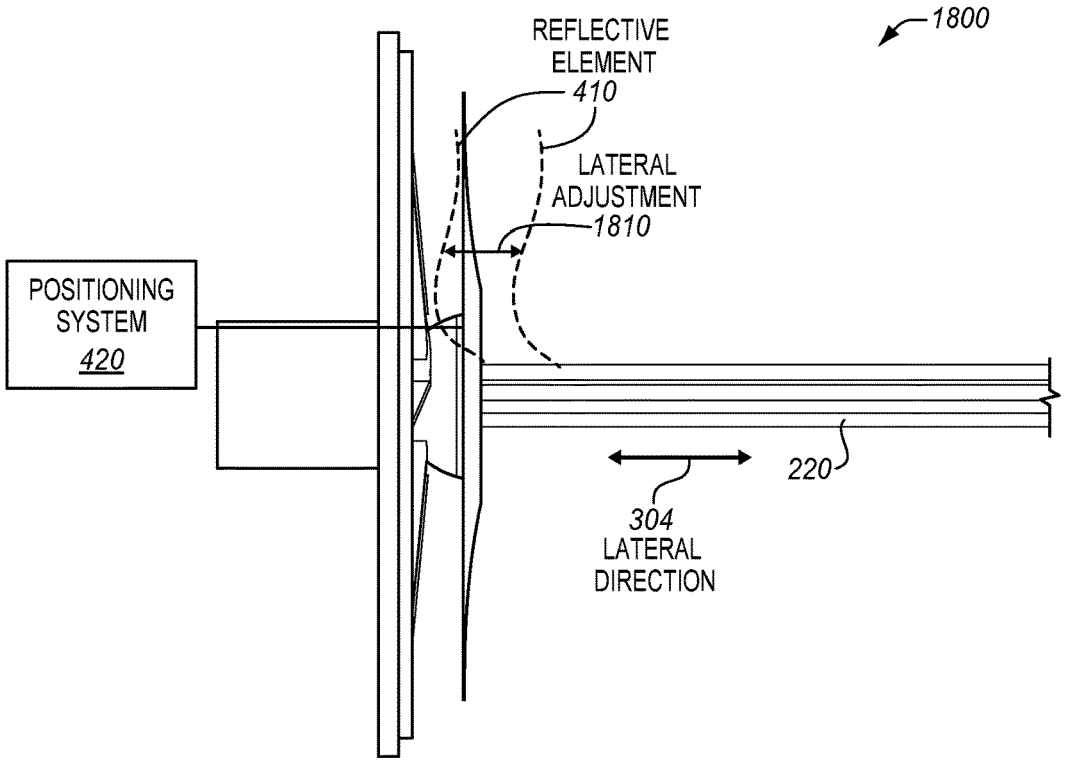
FIG. 18 illustrates a side view of a reflective element configured for lateral adjustment 1810 in an exemplary embodiment.
Figure 19:
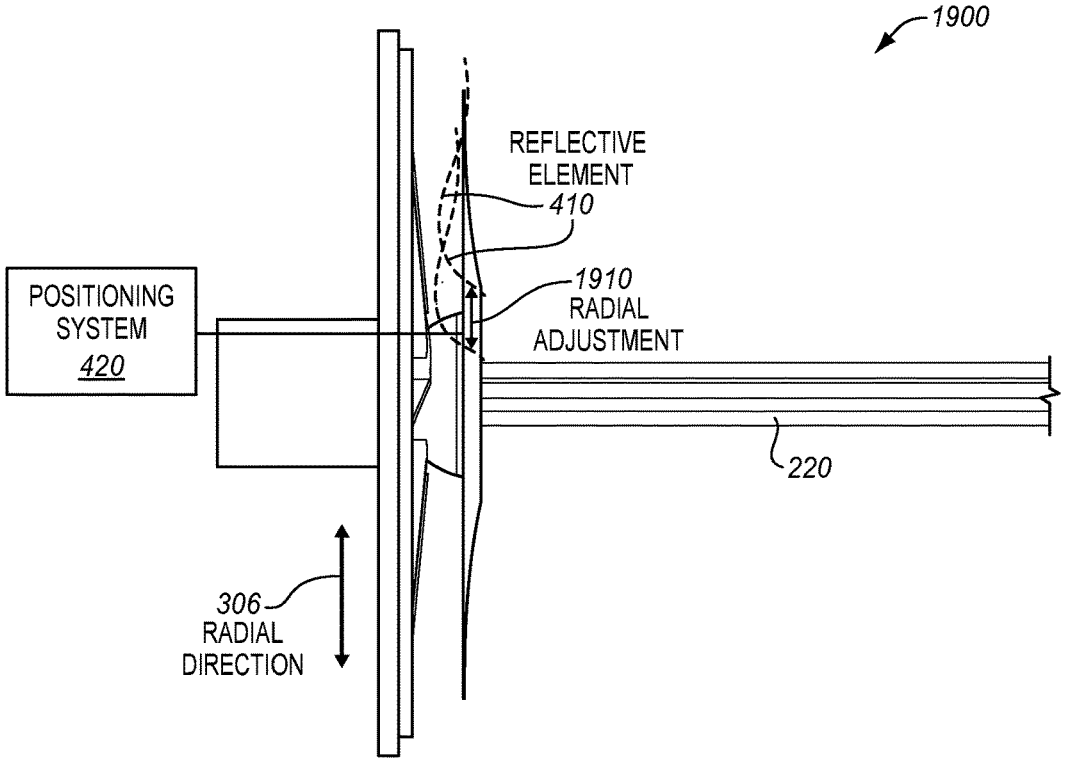
FIG. 19 illustrates a side view of a reflective element configured for radial adjustment in an exemplary embodiment.
Figure 20:
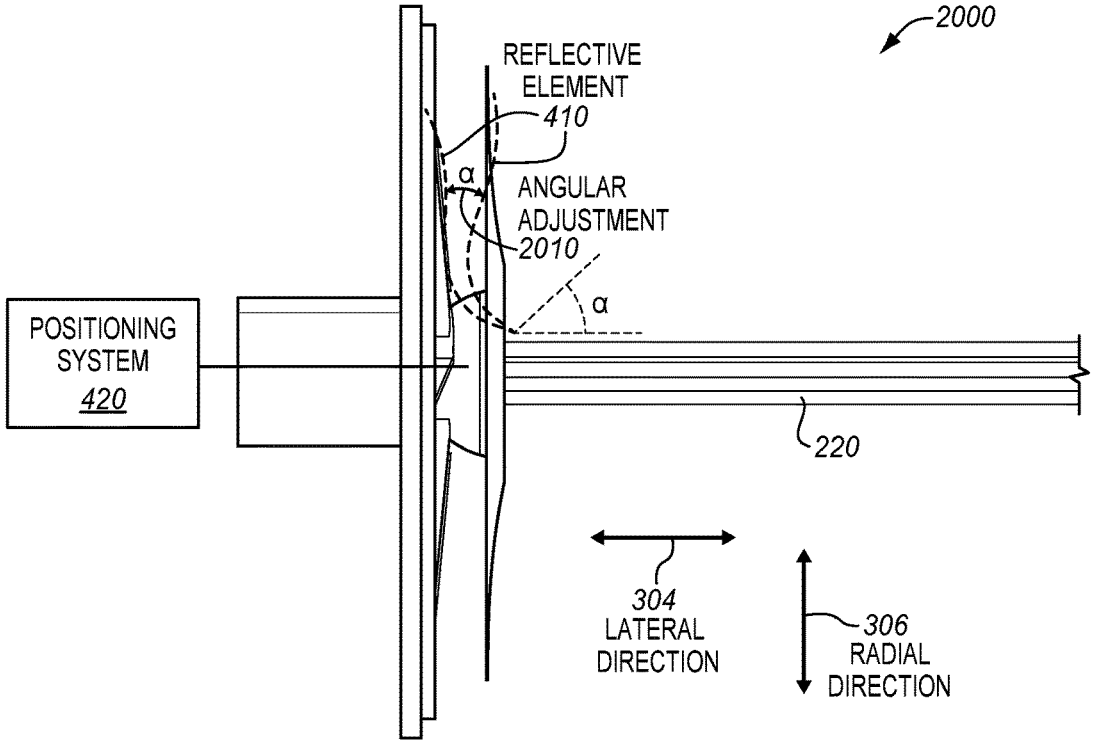
FIG. 20 illustrates a side view of a reflective element configured for angular adjustment in an exemplary embodiment.
Figure 21:
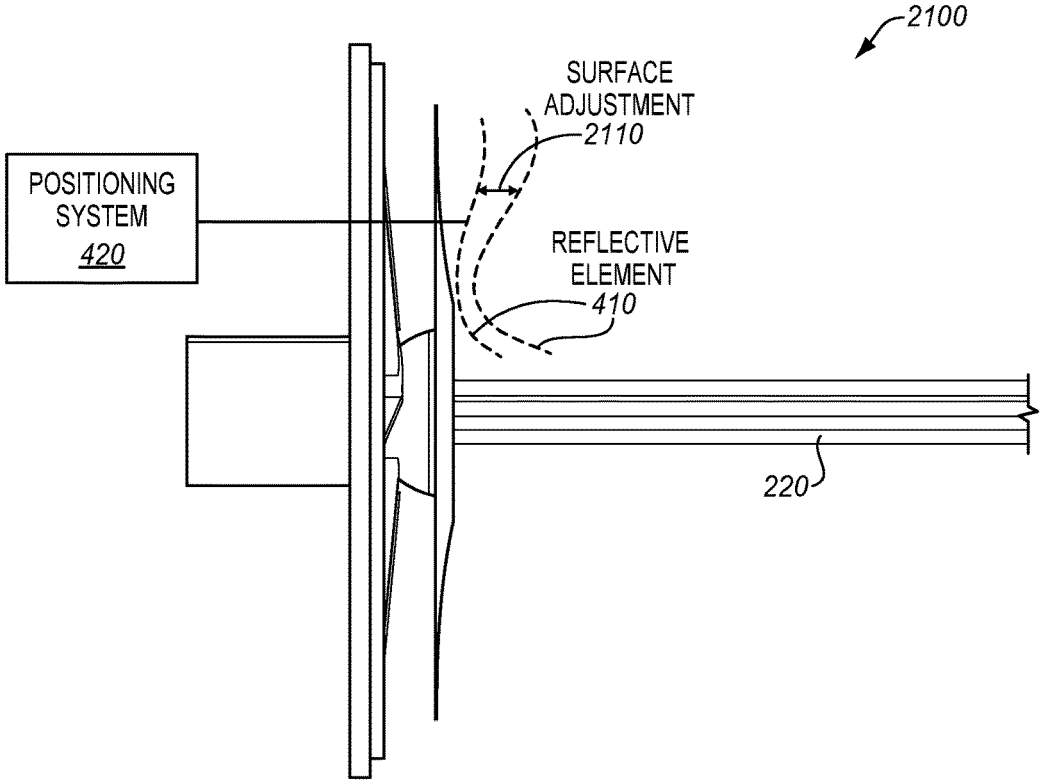
FIG. 21 illustrates a side view of a reflective element configured for surface adjustment in an exemplary embodiment.

FIG. 18 illustrates a side view of reflective element 410 configured for lateral adjustment 1810 in an exemplary embodiment. FIG. 19 illustrates a side view of reflective element 410 configured for radial adjustment 1910 in an exemplary embodiment. FIG. 20 illustrates a side view of reflective element 410 configured for angular adjustment 2010 in an exemplary embodiment. FIG. 21 illustrates a side view of reflective element 410 configured for surface adjustment 2110 in an exemplary embodiment. Positioning system 420 may contact reflective element 410 to perform one or more lateral adjustments 1810, radial adjustments 1910, angular adjustment 2010, and/or surface adjustments 2110 for reflective element 410 or a portion thereof based on controller 430 input.

Figure 22:
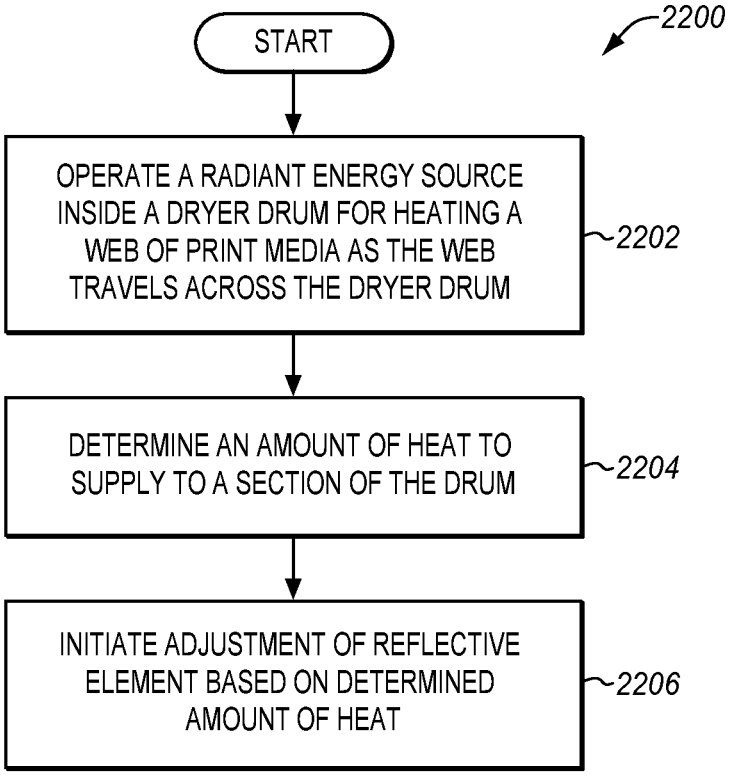
FIG. 22 describes a method for adjusting a reflective element of a drum in an exemplary embodiment.

The particular arrangement, number, and configuration of components described herein is exemplary and non-limiting. Illustrative details of the operation of drum 210 will be discussed with regard to FIG. 22, which describes a method 2200 for adjusting reflective element 410 of drum 210 in an exemplary embodiment. The steps are not inclusive, may include other steps not shown, and may also be performed in an alternative order.

In step 2202, radiant energy source 220 operates inside drum 210 and heats web 120 as web 120 travels across drum 210. In step 2204, controller 430 determines an amount of heat to supply to a lateral section of drum 210. And, in step 2206, positioning system 420 initiates adjustment of reflective element 410 based on the determined amount of heat to supply to the lateral section of drum 210.

Figure 23:
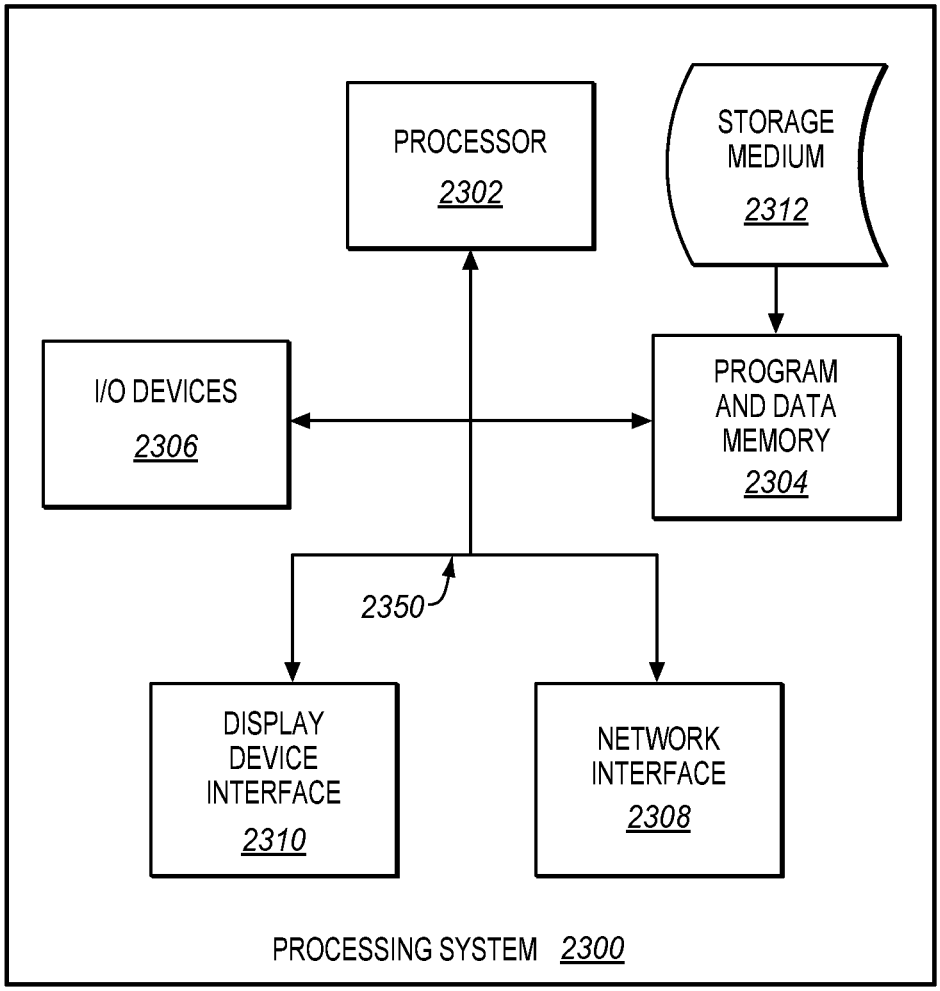
FIG. 23 illustrates a processing system configured to execute a computer readable medium embodying programmed instructions to perform desired functions in an exemplary embodiment.

Controller 430 may perform the operations and functions described herein by executing one or more sequences of instructions stored on a machine/computer readable medium. Controller 430 may be implemented, for example, as custom circuitry, as a processor executing programmed instructions, etc. Embodiments disclosed herein can take the form of software, hardware, firmware, or various combinations thereof. FIG. 23 illustrates a processing system 2300 configured to execute a computer readable medium embodying programmed instructions to perform desired functions in an exemplary embodiment. Processing system 2300 is configured to perform the above operations by executing programmed instructions tangibly embodied on computer readable storage medium 2312. In this regard, embodiments of the invention can take the form of a computer program accessible via computer-readable medium 2312 providing program code for use by a computer or any other instruction execution system. For the purposes of this description, computer readable storage medium 2312 can be anything that can contain or store the program for use by the computer.

Computer readable storage medium 2312 can be an electronic, magnetic, optical, electromagnetic, infrared, or semiconductor device. Examples of computer readable storage medium 2312 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 2300, being suitable for storing and/or executing the program code, includes at least one processor 2302 coupled to program and data memory 2304 through a system bus 2350. Program and data memory 2304 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 2306 (including but not limited to keyboards, displays, pointing devices, sensors, etc.) can be coupled either directly or through intervening I/O controllers. Network adapter interfaces 2308 may also be integrated with the system to enable processing system 2300 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 2310 may be integrated with the system to interface to one or more presentation devices, such as printing systems and displays for presentation of presentation data generated by processor 2302.

Although specific embodiments were described herein, the scope of the inventive concepts is not limited to those specific embodiments. The scope of the inventive concepts is defined by the following claims and any equivalents thereof.

We claim:

1. A dryer comprising:

a thermally conductive drum configured to contact a web at a portion of the drum for drying the web, and to house a radiant energy source inside the drum; and a reflective element at a lateral end of the drum, wherein at least a portion of the reflective element is configured to direct radiant energy towards the portion of the drum in contact with the web.

2. The dryer of claim 1 wherein:

the reflective element comprises a surface with a rotational symmetry of order N where N is greater or equal to two.

3. The dryer of claim 1 wherein:

the reflective element comprises multiple panels each extending in a radial direction toward an interior circumference of the drum.

4. The dryer of claim 3 wherein:

at least one of the panels includes multiple sections attached to one another about a hinge joint; and each section in the at least one of the panels is configured to adjust independently from other sections in the at least one of the panels.

5. The dryer of claim 3 wherein:

the panels are offset from one another in the lateral direction and configured to collapse on one another in a circular direction about the axis.

6. The dryer of claim 1 wherein:

the reflective element comprises multiple concentric circumferential portions.

7. The dryer of claim 6 wherein:

the concentric circumferential portions are configured to adjust independently within drum.

8. The dryer of claim 7 further comprising:

at least one concentric circumferential portion includes multiple sections configured to adjust independently from other sections in the at least one concentric circumferential portion.

9. The dryer of claim 1 further comprising:

a thermal insulation structure disposed between the reflective element and the lateral end of the drum.

10. The dryer of claim 9 further comprising:

a positioning system configured to adjust the reflective element; and a controller configured to direct the positioning system based on a determined amount of heat to supply to a section of the drum.

11. The dryer of claim 1 wherein:

the web comprises print media.

12. The dryer of claim 1 wherein:

the reflective element comprises a curved reflective surface.

13. A printer to apply marking fluid to the web that enters the dryer of claim 1.

* * * * *